US011796212B2

(12) United States Patent
Watanabe et al.

(10) Patent No.: US 11,796,212 B2
(45) Date of Patent: Oct. 24, 2023

(54) AIR-CONDITIONING APPARATUS

(71) Applicant: Mitsubishi Electric Corporation, Tokyo (JP)

(72) Inventors: Kazuya Watanabe, Tokyo (JP); Shohei Ishimura, Tokyo (JP); Koji Fukui, Tokyo (JP); Kojiro Katayama, Tokyo (JP); Kosuke Tanaka, Tokyo (JP); Kazuki Okada, Tokyo (JP); Kazushige Baba, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 174 days.

(21) Appl. No.: 17/437,834

(22) PCT Filed: Apr. 11, 2019

(86) PCT No.: PCT/JP2019/015806
§ 371 (c)(1),
(2) Date: Sep. 10, 2021

(87) PCT Pub. No.: WO2020/208776
PCT Pub. Date: Oct. 15, 2020

(65) Prior Publication Data
US 2022/0154966 A1 May 19, 2022

(51) Int. Cl.
*F25B 41/30* (2021.01)
*F24F 11/84* (2018.01)
*F24F 1/0068* (2019.01)

(52) U.S. Cl.
CPC ..... *F24F 11/84* (2018.01); *F24F 1/0068* (2019.02)

(58) Field of Classification Search
CPC ..... F25B 2313/025; F25B 2313/0251; F25B 2313/0252; F25B 2313/02521;
(Continued)

(56) References Cited

U.S. PATENT DOCUMENTS

2009/0241569 A1* 10/2009 Okada ..... F25B 40/00 165/104.19
2011/0232308 A1* 9/2011 Morimoto ..... F25B 13/00 62/278
(Continued)

FOREIGN PATENT DOCUMENTS

CN 105723168 A 6/2016
JP 2008-157558 A 7/2008
(Continued)

OTHER PUBLICATIONS

International Search Report and Written Opinion dated Jun. 18, 2019, received for PCT Application PCT/JP2019/015806, filed on Apr. 11, 2019, 6 pages including English Translation.
(Continued)

*Primary Examiner* — Frantz F Jules
*Assistant Examiner* — Jason N Thompson
(74) *Attorney, Agent, or Firm* — XSENSUS LLP

(57) ABSTRACT

An air-conditioning apparatus includes a controller configured to operate in a heating normal operation mode and a heating-defrosting operation mode. In a case of switching from the heating normal operation mode to the heating-defrosting operation mode, the controller makes a selection from an initial control mode 1, in which control is performed such that an initial frequency of the compressor is set to a predetermined maximum frequency and an initial opening degree of the flow control device is set to an opening degree lower than a predetermined maximum opening degree, and an initial control mode 2, in which control is performed such that the initial opening degree of the flow control device is set to the predetermined maximum opening degree and the initial frequency of the compressor is set to a frequency lower than the predetermined maximum frequency, to execute the heating-defrosting operation mode.

13 Claims, 11 Drawing Sheets

(58) Field of Classification Search
CPC .. F25B 2313/02522; F25B 2313/02523; F25B 2313/0253; F25B 2313/02531; F25B 2313/02532; F25B 40/053; F25B 2400/053; F25B 2400/16; F25B 2600/2523; F25B 41/30
See application file for complete search history.

(56) References Cited

U.S. PATENT DOCUMENTS

| | | | | |
|---|---|---|---|---|
| 2013/0305764 | A1* | 11/2013 | Korenaga | F24F 3/065 62/324.6 |
| 2015/0292789 | A1 | 10/2015 | Takenaka et al. | |
| 2016/0273795 | A1 | 9/2016 | Takenaka et al. | |
| 2017/0074552 | A1* | 3/2017 | Park | F25B 47/022 |
| 2017/0130996 | A1* | 5/2017 | Hatanaka | F25B 13/00 |
| 2017/0370627 | A1* | 12/2017 | Takenaka | F25B 13/00 |
| 2021/0095905 | A1* | 4/2021 | Tashiro | F24F 1/30 |

FOREIGN PATENT DOCUMENTS

| | | | |
|---|---|---|---|
| JP | 2010-281492 | A | 12/2010 |
| WO | 2014/083867 | A1 | 6/2014 |
| WO | 2017/098669 | A1 | 6/2017 |

OTHER PUBLICATIONS

Chinese Office Action dated Sep. 1, 2022 in corresponding Chinese Patent Application No. 201980094944.0 (with machine-generated English translation), 14 pages.

* cited by examiner

| DEVICE NUMBER | COOLING OPE-RATION | HEATING OPERATION | | |
|---|---|---|---|---|
| | | NORMAL HEATING OPE-RATION | HEATING-DEFROSTING OPERATION | |
| | | | 50 : EVAPORATOR<br>51 : DEFROST | 50 : DEFROST<br>51 : EVAPORATOR |
| 2 | OFF | ON | ON | ON |
| 9a | ON | ON | ON | OFF |
| 9b | ON | ON | OFF | ON |
| 10a | OFF | OFF | OFF | ON |
| 10b | OFF | OFF | ON | OFF |

AIR-CONDITIONING APPARATUS

CROSS-REFERENCE TO RELATED APPLICATION

The present application is based on PCT filing PCT/JP2019/015806, filed Apr. 11, 2019, the entire contents of which are incorporated herein by reference.

TECHNICAL FIELD

The present disclosure relates to an air-conditioning apparatus that can improve the comfort of an indoor space.

BACKGROUND ART

Recently, in terms of global environment protection, there are more cases in which heat pump air-conditioning apparatuses using air as a heat source are introduced to regions in a cold climate to replace boiler heating devices that perform heating by burning fossil fuel. Heat pump air-conditioning apparatuses can perform heating more efficiently by an amount resulting from heat supplied from air in addition to an electrical input to a compressor. However, in a heat pump air-conditioning apparatus, an outdoor heat exchanger functioning as an evaporator frosts over when the outdoor temperature becomes low, and thus defrosting needs to be performed to melt frost formed on the outdoor heat exchanger. As a defrosting method, there is a method in which the direction of flow of refrigerant for heating is reversed. However, heating of the indoor space is stopped during defrosting, causing a reduction in comfort.

In, for example, Patent Literature 1, as a device that can perform heating even during defrosting, an air-conditioning apparatus has been proposed that divides an outdoor heat exchanger and performs heating by causing, while defrosting a portion of the outdoor heat exchanger, the other portion of the heat exchanger to operate as an evaporator. In the air-conditioning apparatus disclosed in Patent Literature 1, the outdoor heat exchanger is divided into a plurality of parallel heat exchangers, and a portion of high-temperature high-pressure refrigerant discharged from a compressor is caused to flow into a parallel heat exchanger from which a defrost request has been issued and defrosting is performed. This enables defrosting to be performed without stopping heating. The amount of refrigerant for defrosting is adjusted by a pressure reducing device provided downstream of the parallel heat exchanger to be defrosted, and in a case where the heating capacity necessary for the indoor space is low, the heating capacity can be prevented from being excessive by increasing the amount of refrigerant for defrosting.

CITATION LIST

Patent Literature

Patent Literature 1: Japanese Unexamined Patent Application Publication No. 2008-157558

SUMMARY OF INVENTION

Technical Problem

In the air-conditioning apparatus described in Patent Literature 1, refrigerant that is caused to flow into the parallel heat exchanger to be defrosted is high in pressure and high in saturation temperature and is likely to condense, and thus the amount of liquid in the parallel heat exchanger increases. Thus, the amount of refrigerant that can be used for heating decreases, leading to a reduction in heating capacity. In a case where the heating load of the indoor space is heavy, the heating capacity becomes insufficient, causing a reduction in the comfort of the indoor space.

The present disclosure has been made to solve problems as described above, and an object thereof is to provide an air-conditioning apparatus that efficiently performs defrosting without stopping heating performed by an indoor unit, adjusts the heating capacity in accordance with the heating load of the indoor space, and can improve the comfort of the indoor space.

Solution to Problem

An air-conditioning apparatus according to an embodiment of the present disclosure is an air-conditioning apparatus including an outdoor unit and an indoor unit connected to the outdoor unit with pipes interposed therebetween. The air-conditioning apparatus includes a main circuit in which a compressor, a load side heat exchanger, a first pressure reducing device, and a plurality of parallel heat exchangers connected in parallel with each other are sequentially connected by the pipes and through which refrigerant circulates, a bypass pipe diverting a portion of refrigerant discharged from the compressor and causing the portion of refrigerant to flow into the parallel heat exchangers, a flow path switching device provided at the bypass pipe and selecting one parallel heat exchanger out of the plurality of parallel heat exchangers as a target to be defrosted, a flow control device provided at the bypass pipe and adjusting an amount of flow of refrigerant flowing in the bypass pipe, and a controller configured to control operation of the outdoor unit and the indoor unit. The controller is configured to operate in a heating normal operation mode for causing all the plurality of parallel heat exchangers to function as an evaporator and a heating-defrosting operation mode for treating one or more parallel heat exchangers out of the plurality of parallel heat exchangers as a target to be defrosted and causing other parallel heat exchangers out of the plurality of parallel heat exchangers to function as an evaporator, and in a case of switching from the heating normal operation mode to the heating-defrosting operation mode, makes a selection from an initial control mode 1, in which control is performed such that an initial frequency of the compressor is set to a predetermined maximum frequency and an initial opening degree of the flow control device is set to an opening degree lower than a predetermined maximum opening degree, and an initial control mode 2, in which control is performed such that the initial opening degree of the flow control device is set to the predetermined maximum opening degree and the initial frequency of the compressor is set to a frequency lower than the predetermined maximum frequency, to execute the heating-defrosting operation mode.

Advantageous Effects of Invention

The air-conditioning apparatus according to an embodiment of the present disclosure has the heating normal operation mode for causing all the plurality of parallel heat exchangers to function as an evaporator and the heating-defrosting operation mode for treating one or more parallel heat exchangers out of the plurality of parallel heat exchangers as a target to be defrosted and causing other parallel heat exchangers out of the plurality of parallel heat exchangers to function as an evaporator, and thus defrosting can be efficiently performed without stopping heating performed by the indoor unit. In the case of switching from the heating normal operation mode to the heating-defrosting operation mode, the frequency of the compressor and the opening degree of the flow control device are determined to execute the heating-defrosting operation mode, and thus the heating capacity can be adjusted in accordance with the heating load of the indoor space. Therefore, a case where the amount of liquid in a parallel heat exchanger increases is less likely to occur and high heating capacity can be obtained, and thus the comfort of the indoor space can be improved.

DESCRIPTION OF EMBODIMENTS

Figure 1:
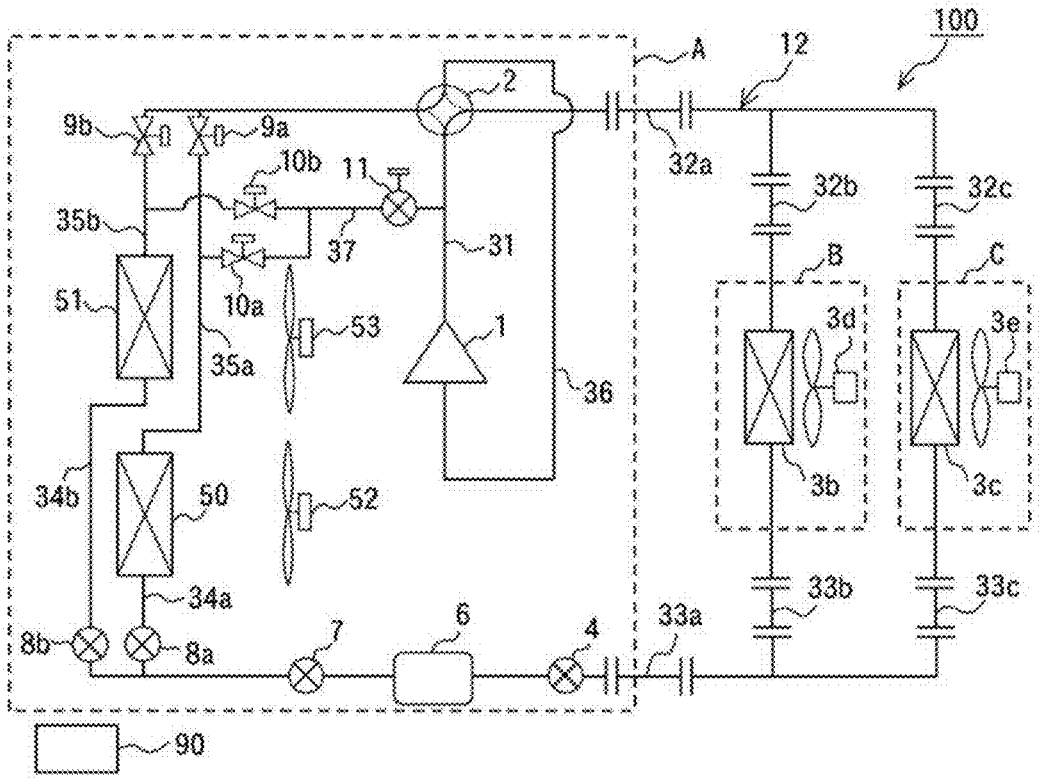
FIG. 1 is a refrigerant circuit diagram of an air-conditioning apparatus according to Embodiment 1.

In the following, Embodiments 1 to 3 will be described with reference to the drawings. Note that, in the individual drawings, the same or corresponding portions are denoted by the same reference numerals, and description thereof will be omitted or simplified as appropriate. Regarding the configuration illustrated in each drawing, its shape, size, arrangement, and so forth can be changed as appropriate.

Embodiment 1

FIG. 1 is a refrigerant circuit diagram of an air-conditioning apparatus according to Embodiment 1. In an air-conditioning apparatus 100, as illustrated in FIG. 1, an outdoor unit A is connected to two indoor units B and C, which are connected in parallel with each other, with pipes therebetween to form a refrigerant circuit for circulating refrigerant. The outdoor unit A functions as a heat source side unit, which generates heat to be supplied to the indoor units B and C. The indoor units B and C function as a load side unit, which uses heat supplied from the outdoor unit A. The outdoor unit A and the indoor units B and C are connected by first extension pipes (32*a*, 32*b*, 32*c*) and second extension pipes (33*a*, 33*b*, 33*c*). Note that, in the air-conditioning apparatus according to Embodiment 1, the example will be described in which the two indoor units B and C are connected to the one outdoor unit A; however, a configuration may be used in which one indoor unit or three or more indoor units are connected to the one outdoor unit A. Moreover, a configuration may be used in which two or more outdoor units are connected in parallel. Moreover, the air-conditioning apparatus may have a refrigerant circuit configuration that enables each indoor unit to perform a cooling-heating simultaneous operation by connecting three extension pipes in parallel or by provision of a switching device on the indoor unit side.

In the air-conditioning apparatus 100, operation of the outdoor unit A and the indoor units B and C is controlled by a controller 90. The controller 90 is formed by a computing unit, which is for example a microprocessor or a central processing unit (CPU), and a software program to be executed by the computing unit. Note that the controller 90 may also be formed by a hardware device such as a circuit device that realizes the function thereof.

As refrigerant flowing through the refrigerant circuit, a fluorocarbon refrigerant or a HFO refrigerant is used. The fluorocarbon refrigerant is, for example, a HFC based refrigerant R32, R125, or R134a or a mixed refrigerant R410A, R407c, or R404A using these refrigerants. The HFO refrigerant is, for example, HFO-1234yf, HFO-1234ze (E), or HFO-1234ze (Z). In addition, as other refrigerants, there are refrigerants used in vapor compression heat pumps such as a $CO_2$ refrigerant, a HC refrigerant, an ammonia refrigerant, and a mixed refrigerant using the refrigerants described above, such as a mixed refrigerant using R32 and HFO-1234yf. Note that the HC refrigerant may be, for example, a propane refrigerant or an isobutane refrigerant.

Next, the configuration of the refrigerant circuit of the air-conditioning apparatus 100 according to Embodiment 1 will be described. The refrigerant circuit of the air-conditioning apparatus 100 has a main circuit 12, in which a compressor 1, a cooling-heating switching device 2, load side heat exchangers 3*b* and 3*c*, a first pressure reducing device 4, and parallel heat exchangers 50 and 51 are sequentially connected by pipes and through which refrigerant circulates. The load side heat exchangers 3*b* and 3*c* are connected in parallel with each other, and the parallel heat exchangers 50 and 51 are connected in parallel with each other. The main circuit 12 also has a receiver 6 and a third pressure reducing device 7, the receiver 6 being provided between the first pressure reducing device 4 and the parallel heat exchangers 50 and 51, the third pressure reducing device 7 being provided between the receiver 6 and the parallel heat exchangers 50 and 51. The compressor 1, the cooling-heating switching device 2, the first pressure reducing device 4, the parallel heat exchangers 50 and 51, the receiver 6, and the third pressure reducing device 7 are arranged in the outdoor unit A. The load side heat exchanger 3*b* is arranged in the indoor unit B. The load side heat exchanger 3*c* is arranged in the indoor unit C.

The compressor 1 compresses refrigerant taken thereinto, brings the refrigerant to its high-temperature high-pressure state, and discharges the high-temperature high-pressure refrigerant. The compressor 1 is, for example, configured to be capable of changing its operating capacity (frequency), and is a positive-displacement compressor driven by a motor controlled by an inverter.

The cooling-heating switching device 2 includes, for example, a four-way valve that switches the direction in which refrigerant flows. The cooling-heating switching device 2 is connected between a discharge pipe 31 of the compressor 1 and a suction pipe 36 of the compressor 1. In a heating operation, a connection is established in the direction of a solid line in the cooling-heating switching device 2 in FIG. 1. In a cooling operation, a connection is established in the direction of a broken line in the cooling-heating switching device 2 in FIG. 1. Note that the cooling-heating switching device 2 may include a combination of two-way valves or three-way valves.

The load side heat exchangers 3*b* and 3*c* function as an evaporator during the cooling operation and exchange heat between the refrigerant having flowed out from the first pressure reducing device 4 and air. The load side heat exchangers 3*b* and 3*c* function as a condenser during the heating operation and exchange heat between the refrigerant discharged from the compressor 1 and air. The load side heat exchangers 3*b* and 3*c* take in indoor air using indoor fans 3*d* and 3*e* and supply air subjected to heat exchange with refrigerant to the indoor space.

The first pressure reducing device 4 and the third pressure reducing device 7 reduce the pressure of refrigerant flowing in the refrigerant circuit, so that the refrigerant expands. The first pressure reducing device 4 and the third pressure reducing device 7 include, for example, a capillary tube or an electronic expansion valve that can control and change its opening degree. The first pressure reducing device 4 and the third pressure reducing device 7 are controlled by the controller 90.

The receiver 6 is a refrigerant container for storing liquid refrigerant, stores excess liquid refrigerant during operation, and has a gas-liquid separation function. The receiver 6 is installed on a refrigerant pipe between the first pressure reducing device 4 and the third pressure reducing device 7.

Figure 2:
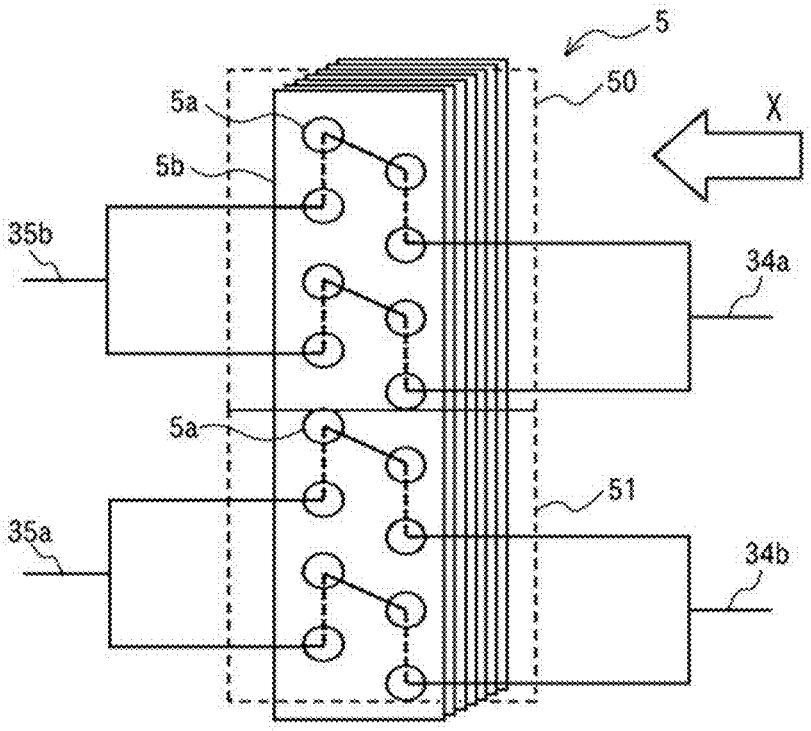
FIG. 2 is an explanatory diagram illustrating an example of parallel heat exchangers in the air-conditioning apparatus according to Embodiment 1.

FIG. 2 is an explanatory diagram illustrating an example of parallel heat exchangers in the air-conditioning apparatus according to Embodiment 1. The parallel heat exchangers 50 and 51 have a configuration obtained by dividing a heat source side heat exchanger 5 into upper and lower portions as illustrated in FIG. 2. The parallel heat exchangers 50 and 51 function as a condenser during the cooling operation and exchange heat between the refrigerant discharged from the compressor 10 and air. The parallel heat exchangers 50 and 51 function as an evaporator during the heating operation and exchange heat between the refrigerant having flowed out from the third pressure reducing device 7 and air. The parallel heat exchanger 50 takes in outdoor air using an outdoor fan 52 and discharges air subjected to heat exchange with refrigerant to an outdoor space. The parallel heat exchanger 51 takes in outdoor air using an outdoor fan 53 and discharges air subjected to heat exchange with refrigerant to an outdoor space. Note that each of the parallel heat exchangers 50 and 51 may be provided with an outdoor fan, or one outdoor fan may be configured to supply outdoor air to the parallel heat exchangers 50 and 51.

The parallel heat exchangers 50 and 51 are, for example, a fin tube heat exchanger having a plurality of heat transfer pipes 5*a* and a plurality of fins 5*b* as illustrated in FIG. 2. The plurality of heat transfer pipes 5*a* are arranged in a step direction and a column direction, the step direction being perpendicular to a direction X in which air passes, the column direction being the direction X. The fins 5*b* are arranged with a space therebetween in the direction X, in which air passes, such that air passes through the spaces.

Since the parallel heat exchangers 50 and 51 are obtained by dividing the heat source side heat exchanger 5 into upper and lower portions, the parallel heat exchangers 50 and 51 are easily connected by pipes. Note that water generated at the upper parallel heat exchanger 50 flows down to the lower parallel heat exchanger 51. Thus, if the lower parallel heat exchanger 51 is caused to function as an evaporator while defrosting the upper parallel heat exchanger 50, water generated by defrosting the upper parallel heat exchanger 50 may freeze at the lower parallel heat exchanger 51, and heat exchange may be hindered.

Note that the parallel heat exchangers 50 and 51 may have a structure obtained by dividing the heat source side heat exchanger 5 into left and right portions although illustration thereof is omitted. When the heat source side heat exchanger 5 is divided into left and right portions, water generated by defrosting one parallel heat exchanger does not come into contact with the other parallel heat exchanger. However, refrigerant inlets of the parallel heat exchangers are positioned at left and right ends of the housing of the outdoor unit A, and thus connection of pipes may become complicated.

In addition, in the parallel heat exchangers 50 and 51, the fins 5*b* may be provided with, for example, a notch or a slit to reduce heat leakage. Moreover, a heat transfer pipe for allowing high-temperature refrigerant to flow may be provided between the parallel heat exchanger 50 and the parallel heat exchanger 51. By reducing heat leakage or being provided with a heat transfer pipe for allowing high-temperature refrigerant to flow, the parallel heat exchangers 50 and 51 can suppress heat leakage from a parallel heat exchanger to be defrosted to a parallel heat exchanger functioning as an evaporator, and thus defrosting is performed more easily at the border between the upper and lower parallel heat exchangers. Note that the air-conditioning apparatus may include three or more parallel heat exchangers. The parallel heat exchangers 50 and 51 are not necessarily obtained by dividing the fins of the heat source side heat exchanger 5 into the upper and lower portions and may be configured as a single unit.

The parallel heat exchanger 50 is connected to the third pressure reducing device 7 with a first connection pipe 34*a* interposed therebetween. The parallel heat exchanger 51 is connected to the third pressure reducing device 7 with a first connection pipe 34*b* interposed therebetween. The first connection pipe 34*a* is provided with a second pressure reducing device 8*a*. The first connection pipe 34*b* is provided with a second pressure reducing device 8*b*. The second pressure reducing devices 8*a* and 8*b* reduce the pressure of refrigerant flowing in the refrigerant circuit to expand the refrigerant, and includes, for example, a capillary tube or an electronic expansion valve that can control and change its opening degree. The second pressure reducing devices 8*a* and 8*b* are controlled by the controller 90.

The parallel heat exchanger 50 is connected to the compressor 1 with a second connection pipe 35*a* interposed therebetween. The parallel heat exchanger 51 is connected to the compressor 1 with a second connection pipe 35*b* interposed therebetween. The second connection pipe 35*a* is provided with a first open-close device 9*a*. The second connection pipe 35*b* is provided with a first open-close device 9*b*. The first open-close devices 9*a* and 9*b* are controlled by the controller 90. Note that it is sufficient that the first open-close devices 9*a* and 9*b* can open and close flow paths, and the first open-close devices 9*a* and 9*b* may have a configuration in which one valve has the function of opening and closing a plurality of flow paths by using, for example, a three-way valve or a four-way valve.

The refrigerant circuit is provided with a bypass pipe 37, one end of which is connected to the discharge pipe 31 and the other end of which is split and connected to the second connection pipes 35*a* and 35*b*. A portion of the high-temperature high-pressure refrigerant discharged from the compressor 1 is supplied to the parallel heat exchanger 50 or 51 by the bypass pipe 37. Note that it is sufficient that the bypass pipe 37 bypass high-temperature high-pressure gas refrigerant discharged from the compressor 1 during the heating operation, and thus its end connected to the discharge pipe 31 may be connected to the first extension pipe 32*a*.

In the bypass pipe 37, a flow control device 11 is provided between a connection point to the discharge pipe 31 and a split point for connection to the second connection pipes 35*a* and 35*b*. In the bypass pipe 37, a second open-close device 10*a* is provided as a flow path switching device between the split point and the second connection pipe 35*a*. In the bypass pipe 37, a second open-close device 10*b* is provided as a flow path switching device between the split point and the second connection pipe 35*b*. The second open-close devices 10*a* and 10*b* are controlled by the controller 90. Note that it is sufficient that the second open-close devices 10*a* and 10*b* can open and close flow paths, and the second open-close devices 10*a* and 10*b* may have a configuration in which one valve has the function of opening and closing a plurality of flow paths by using, for example, a three-way valve or a four-way valve. A configuration may also be used in which the flow control device 11 is omitted by using, as the second open-close devices 10*a* and 10*b*, a flow control device that can adjust its opening degree.

Next, the operation of various operations executed by the air-conditioning apparatus 100 according to Embodiment 1 will be described. The operation of the air-conditioning apparatus 100 has two kinds of operation modes, which are a cooling operation and a heating operation. Furthermore, the heating operation has a heating normal operation mode and a heating-defrosting operation mode. In the heating normal operation mode, both the parallel heat exchangers 50 and 51 operate as normal evaporators. In the heating-defrosting operation mode, one of the parallel heat exchangers 50 and 51 is defrosted while continuing the heating operation. Note that the heating-defrosting operation mode may also be referred to as a continuous heating operation.

In the heating-defrosting operation mode, while performing the heating operation by causing the parallel heat exchanger 50, which is one of the parallel heat exchangers, to operate as an evaporator, the other parallel heat exchanger 51 is defrosted. After defrosting of the other parallel heat exchanger 51 is completed, the heating operation is performed by causing the other parallel heat exchanger 51 to operate as an evaporator this time, and the one parallel heat exchanger 50 is defrosted. By repeatedly performing this, both of the parallel heat exchangers 50 and 51 are defrosted while continuing the heating operation.

Figures 3, 4:
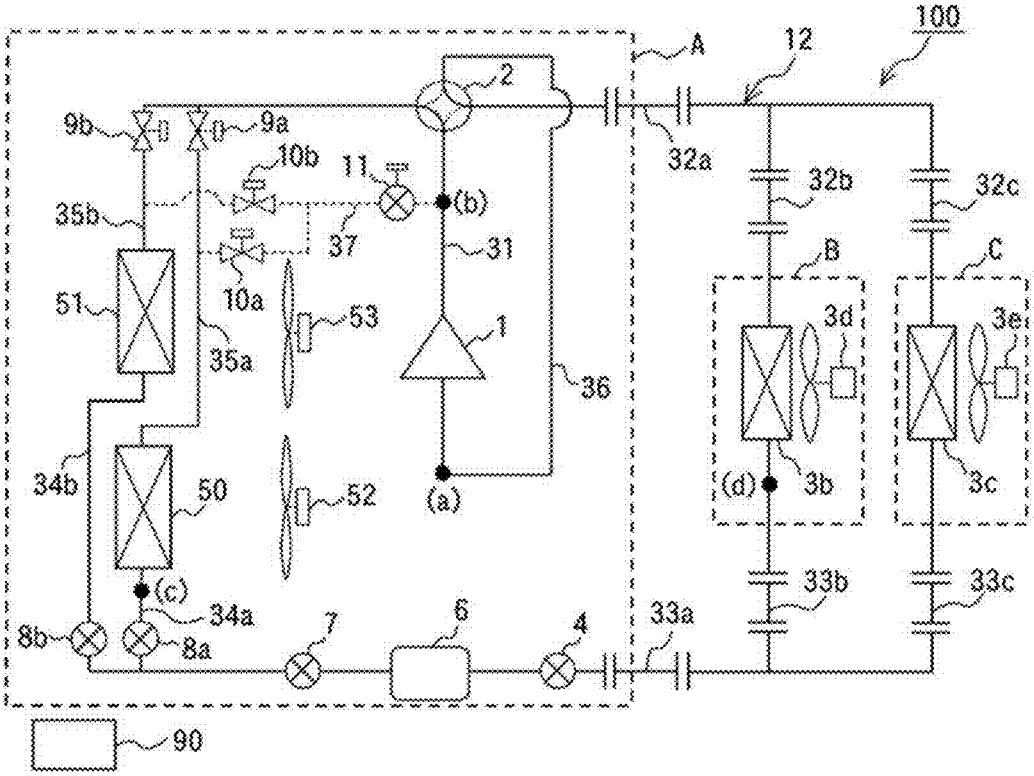
FIG. 3 is an explanatory diagram illustrating the ON/OFF states of a cooling-heating switching device and open-close devices in individual operation modes in the air-conditioning apparatus according to Embodiment 1.
FIG. 4 is a refrigerant circuit diagram of the air-conditioning apparatus according to Embodiment 1, the diagram illustrating the flow of refrigerant during a cooling operation.

FIG. 3 is an explanatory diagram illustrating the ON/OFF states of the cooling-heating switching device and the open-close devices in each operation mode in the air-conditioning apparatus according to Embodiment 1. Regarding the cooling-heating switching device 2, ON illustrated in FIG. 3 corresponds to a case where a connection is established in the direction of the solid line of the cooling-heating switching device 2 illustrated in FIG. 1. Regarding the cooling-heating switching device 2, OFF illustrated in FIG. 3 corresponds to a case where a connection is established in the direction of the broken line of the cooling-heating switching device 2 illustrated in FIG. 1. Regarding the first open-close devices 9*a* and 9*b* and the second open-close devices 10*a* and 10*b*, ON corresponds to a case where the open-close device is open and refrigerant flows. Regarding the first open-close devices 9*a* and 9*b* and the second open-close devices 10*a* and 10*b*, OFF corresponds to a case where the open-close device is closed.

[Cooling Operation]

Figure 5:
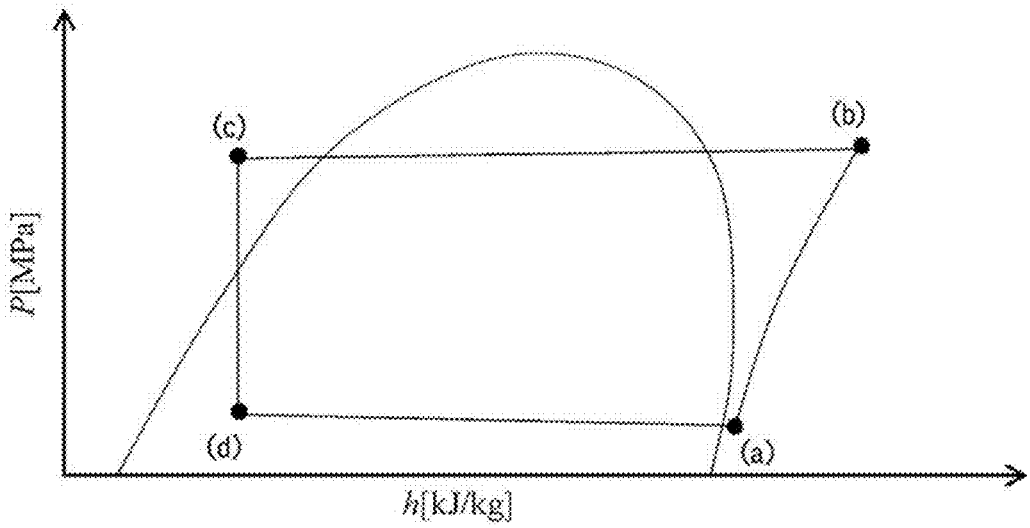
FIG. 5 is a P-h diagram of the air-conditioning apparatus according to Embodiment 1 at the time of the cooling operation.

FIG. 4 is a refrigerant circuit diagram of the air-conditioning apparatus according to Embodiment 1, the diagram illustrating the flow of refrigerant during the cooling operation. Note that, in FIG. 4, the portion where refrigerant flows during the cooling operation is indicated by a solid line, and the portion where refrigerant does not flow during the cooling operation is indicated by a broken line. FIG. 5 is a P-h diagram of the air-conditioning apparatus according to Embodiment 1 at the time of the cooling operation. Note that points (a) to (d) of FIG. 5 illustrate states of refrigerant at the portions denoted by the same marks in FIG. 4.

When the compressor 1 starts operating, low-temperature low-pressure gas refrigerant is compressed by the compressor 1, and high-temperature high-pressure gas refrigerant is discharged. In this refrigerant compression process of the compressor 1, compared with a case where adiabatic compression is performed along an isentropic line, compression is performed such that heating is performed by an amount corresponding to the adiabatic efficiency of the compressor 1, and the refrigerant compression process is represented by the line from point (a) to point (b) of FIG. 5.

The high-temperature high-pressure gas refrigerant discharged from the compressor 1 passes through the cooling-heating switching device 2, is split into two, passes through the first open-close devices 9*a* and 9*b*, and flows into the parallel heat exchangers 50 and 51 from the second connection pipes 35*a* and 35*b*, the parallel heat exchangers 50 and 51 being respectively connected to the second connection pipes 35*a* and 35*b*. The refrigerant that has flowed into the parallel heat exchangers 50 and 51 is cooled while heating outdoor air and becomes middle-temperature high-pressure liquid refrigerant. When pressure loss is taken into consideration, the changes in refrigerant at the parallel heat exchangers 50 and 51 are represented by the straight line from point (b) to point (c) of FIG. 5, which is slightly inclined and close to horizontal. Note that in a case where, for example, the operating capacity of the indoor units B and C is small, one of the first open-close devices 9*a* and 9*b* may be closed to prevent refrigerant from flowing through either of the parallel heat exchangers 50 and 51. As a result, in this case, the heat transfer area of the heat source side heat exchanger 5 becomes small, and a stable cycle operation can be performed.

The flows of middle-temperature high-pressure liquid refrigerant flowing out from the parallel heat exchangers 50 and 51 flow into the first connection pipes 34*a* and 34*b*, pass through the second pressure reducing devices 8*a* and 8*b*, and then merge. The resulting refrigerant is expanded and subjected to pressure reduction by passing through the third pressure reducing device 7, the receiver 6, and the first pressure reducing device 4, and enters a low-temperature low-pressure two-phase gas-liquid state. The changes in refrigerant at the second pressure reducing devices 8*a* and 8*b*, the third pressure reducing device 7, and the first pressure reducing device 4 are made under constant enthalpy. The changes in refrigerant in this case are represented by the vertical line from point (c) to point (d) of FIG. 5.

The refrigerant that has flowed out from the first pressure reducing device 4 and that is in the low-temperature low-pressure two-phase gas-liquid state flows out from the outdoor unit A, passes through the second extension pipes (33*a*, 33*b*, 33*c*), and flows into the load side heat exchanger 3*b* of the indoor unit B and the load side heat exchanger 3*c* of the indoor unit C. The refrigerant that has flowed into the load side heat exchangers 3*b* and 3*c* is heated while cooling indoor air, and becomes low-temperature low-pressure gas refrigerant. When pressure loss is taken into consideration, the changes in refrigerant at the load side heat exchangers 3*b* and 3*c* are represented by the straight line from point (d) to point (a) of FIG. 5, which is slightly inclined and close to horizontal.

The low-temperature low-pressure gas refrigerant that has flowed out from the load side heat exchangers 3*b* and 3*c* returns to the outdoor unit A through the first extension pipes (32*a*, 32*b*, 32*c*), flows into the compressor 1 through the cooling-heating switching device 2, and is compressed.

[Heating Normal Operation Mode]

Figure 6:
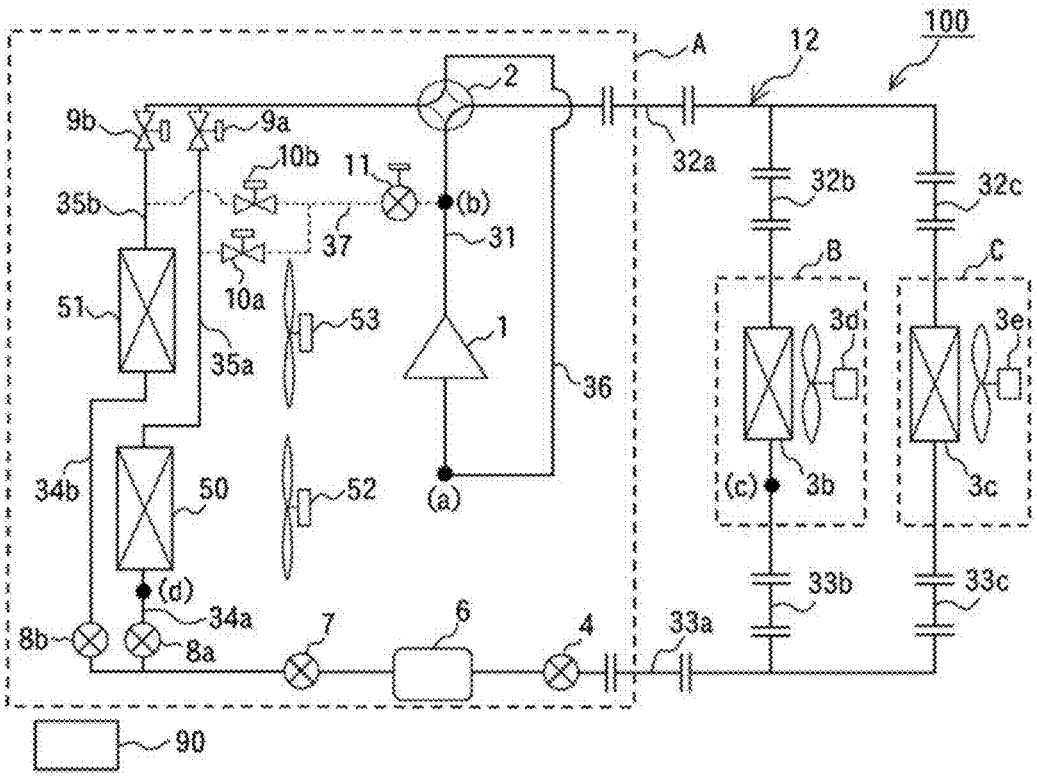
FIG. 6 is a refrigerant circuit diagram of the air-conditioning apparatus according to Embodiment 1, the diagram illustrating the flow of refrigerant during a heating normal operation mode.
Figure 7:
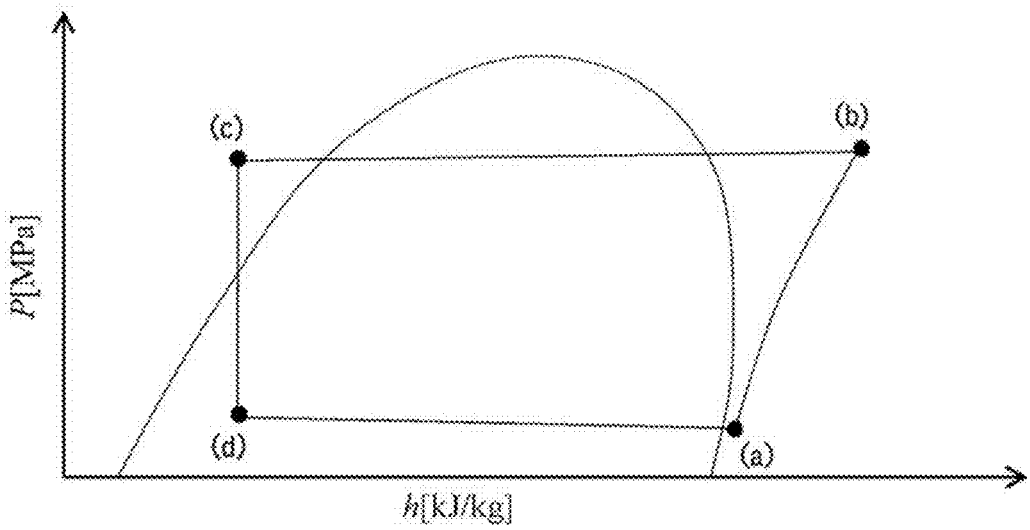
FIG. 7 is a P-h diagram of the air-conditioning apparatus according to Embodiment 1 at the time of the heating normal operation mode.

FIG. 6 is a refrigerant circuit diagram of the air-conditioning apparatus according to Embodiment 1, the diagram illustrating the flow of refrigerant during the heating normal operation mode. Note that, in FIG. 6, the portion where refrigerant flows during the heating normal operation mode is indicated by a solid line, and the portion where refrigerant does not flow during the heating normal operation mode is indicated by a broken line. FIG. 7 is a P-h diagram of the air-conditioning apparatus according to Embodiment 1 at the time of the heating normal operation mode. Note that points (a) to (e) of FIG. 7 illustrate states of refrigerant at the portions denoted by the same marks in FIG. 6.

When the compressor 1 starts operating, low-temperature low-pressure gas refrigerant is compressed by the compressor 1, and high-temperature high-pressure gas refrigerant is discharged. In this refrigerant compression process of the compressor 1, compared with a case where adiabatic compression is performed along an isentropic line, compression is performed such that heating is performed by an amount corresponding to the adiabatic efficiency of the compressor 1, and the refrigerant compression process is represented by the line from point (a) to point (b) of FIG. 7.

The high-temperature high-pressure gas refrigerant discharged from the compressor 1 passes through the cooling-heating switching device 2 and then flows out from the outdoor unit A. The high-temperature high-pressure gas refrigerant that has flowed out from the outdoor unit A flows into the load side heat exchanger 3*b* of the indoor unit B and the load side heat exchanger 3*c* of the indoor unit C via the first extension pipes (32*a*, 32*b*, 32*c*). The refrigerant that has flowed into the load side heat exchangers 3*b* and 3*c* is cooled while heating indoor air and becomes middle-temperature high-pressure liquid refrigerant. When pressure loss is taken into consideration, the changes in refrigerant at the load side heat exchangers 3*b* and 3*c* are represented by the straight line from point (b) to point (c) of FIG. 7, which is slightly inclined and close to horizontal.

The middle-temperature high-pressure liquid refrigerant that has flowed out from the load side heat exchangers 3*b* and 3*c* returns to the outdoor unit A via the second extension pipes (33*a*, 33*b*, 33*c*). The refrigerant that has returned to the outdoor unit A passes through the first pressure reducing device 4, the receiver 6, and the third pressure reducing device 7, is split, passes through the first connection pipes 34*a* and 34*b*, and then flows into the second pressure reducing devices 8*a* and 8*b*. The refrigerant is expanded and subjected to pressure reduction by the first pressure reducing device 4, the third pressure reducing device 7, and the second pressure reducing devices 8*a* and 8*b*, and enters a low-temperature low-pressure two-phase gas-liquid state. The changes in refrigerant at the first pressure reducing device 4, the third pressure reducing device 7, and the second pressure reducing devices 8*a* and 8*b* are made under constant enthalpy. The changes in refrigerant in this case are represented by the vertical line from point (c) to point (d) of FIG. 7.

The refrigerant that has flowed out from the second pressure reducing devices 8*a* and 8*b* flows into the parallel heat exchangers 50 and 51, is heated while cooling outdoor air, and becomes low-temperature low-pressure gas refrigerant. When pressure loss is taken into consideration, the changes in refrigerant at the parallel heat exchangers 50 and 51 are represented by the straight line from point (d) to point (a) of FIG. 7, which is slightly inclined and close to horizontal. The flows of low-temperature low-pressure gas refrigerant that have flowed out from the parallel heat exchangers 50 and 51 flow into the second connection pipes 35*a* and 35*b*, pass through the first open-close devices 9*a* and 9*b*, and then merge. The resulting refrigerant passes through the cooling-heating switching device 2, flows into the compressor 1, and is compressed.

[Heating-Defrosting Operation Mode (Continuous Heating Operation)]

The heating-defrosting operation mode is executed in a case where the heat source side heat exchanger 5 becomes frosted over during the heating normal operation mode. The controller 90 determines the presence or absence of frost formed on the heat source side heat exchanger 5, and determines whether the heating-defrosting operation mode needs to be executed. The presence or absence of frost formed is determined, for example, on the basis of the saturation temperature of refrigerant converted from the suction pressure of the compressor 1. In a case where the saturation temperature of refrigerant has become significantly lower than a set outdoor temperature and becomes lower than a threshold, the controller 90 determines that frost that needs to be defrosted is formed on the outdoor heat exchanger 5. As another example, in a case where the temperature difference between the outdoor temperature and the evaporating temperature becomes greater than or equal to a preset value and where at least a predetermined time has elapsed in the state, the controller 90 determines that frost that needs to be defrosted is formed on the heat source side heat exchanger 5. Note that the presence or absence of frost formed does not have to be determined by using these methods and may also be determined by using other methods. When determining that frost is formed on the heat source side heat exchanger 5, the controller 90 determines that the conditions for starting the heating-defrosting operation mode are met.

With the configuration of the air-conditioning apparatus 100 according to Embodiment 1, in the heating-defrosting operation mode, there is an operation in which the one parallel heat exchanger 51 is selected as a target to be defrosted and is defrosted and in which heating is continued by causing the other parallel heat exchanger 50 to function as an evaporator. In contrast, there is an operation in which the other parallel heat exchanger 50 is selected as a target to be defrosted and is defrosted and in which the one parallel heat exchanger 51 is caused to function as an evaporator. In these operations, the open-close states of the first open-close devices 9*a* and 9*b* and the open-close states of the second open-close devices 10*a* and 10*b* are switched between the open-close state for the devices connected to the parallel heat exchanger to be defrosted and the open-close state for the devices connected to the parallel heat exchanger functioning as an evaporator. In these operations, only the flows of refrigerant through the parallel heat exchangers are switched, and the rest of the operations are the same. Thus, in the following description, an operation in a case where the parallel heat exchanger 51 is to be defrosted and heating is continued by causing the parallel heat exchanger 50 to function as an evaporator will be described. The same applies to description of Embodiment 2 and Embodiment 3 below.

Figure 8:
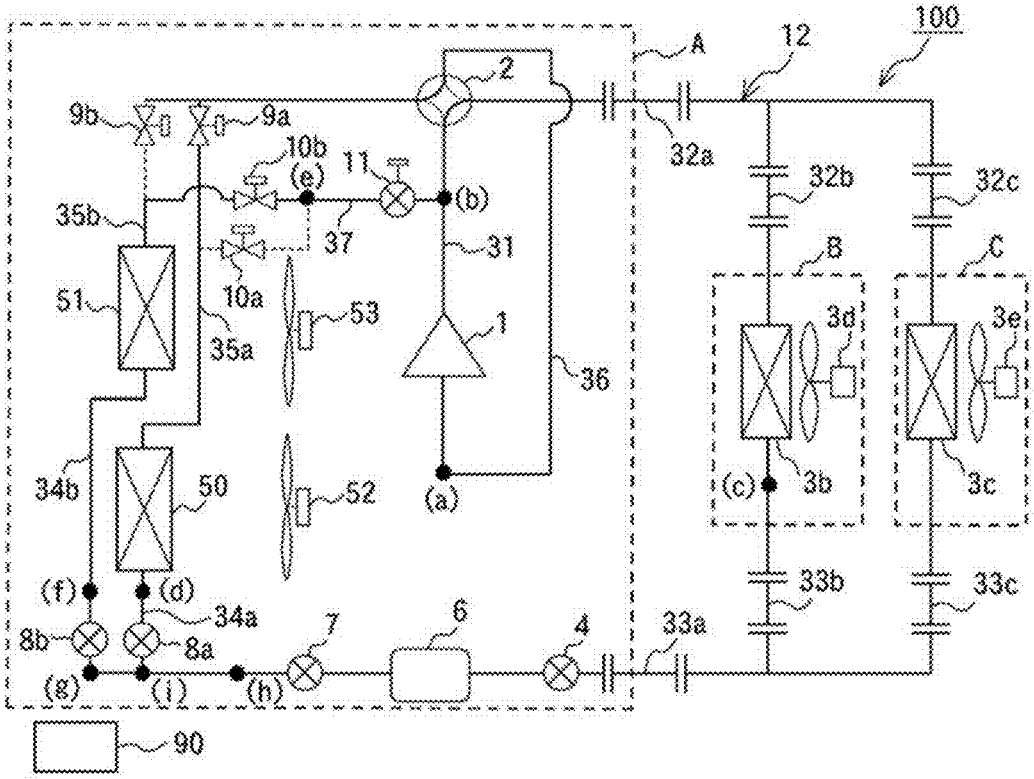
FIG. 8 is a refrigerant circuit diagram of the air-conditioning apparatus according to Embodiment 1, the diagram illustrating the flow of refrigerant during a heating-defrosting operation mode.
Figure 9:
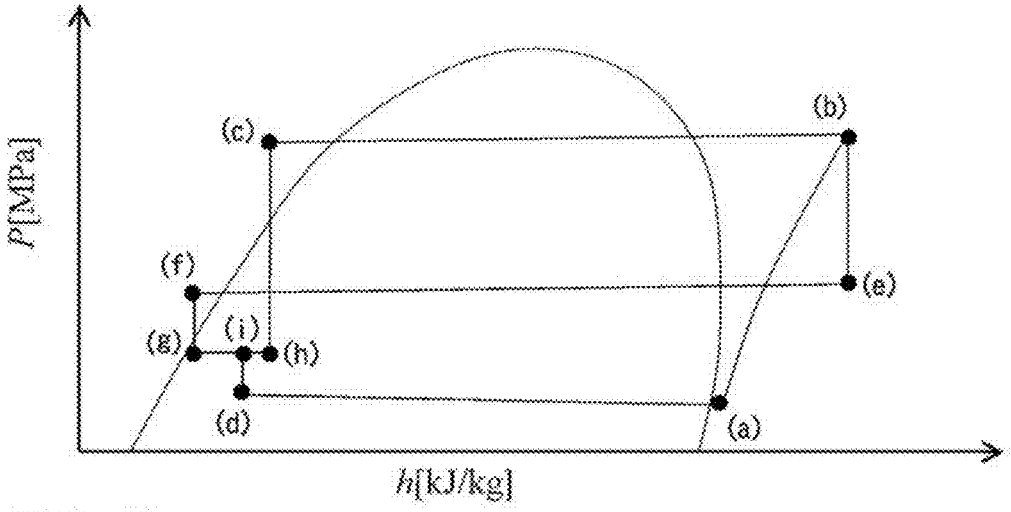
FIG. 9 is a P-h diagram of the air-conditioning apparatus according to Embodiment 1 at the time of the heating-defrosting operation mode.

FIG. 8 is a refrigerant circuit diagram of the air-conditioning apparatus according to Embodiment 1, the diagram illustrating the flow of refrigerant during the heating-defrosting operation mode. Note that, in FIG. 8, the portion where refrigerant flows during the heating-defrosting operation mode is indicated by a solid line, and the portion where refrigerant does not flow during the heating-defrosting operation mode is indicated by a broken line. FIG. 9 is a P-h diagram of the air-conditioning apparatus according to Embodiment 1 at the time of the heating-defrosting operation mode. Note that points (a) to (g) of FIG. 9 illustrate states of refrigerant at the portions denoted by the same marks in FIG. 8.

During the heating-defrosting operation mode in which the parallel heat exchanger 51 is to be defrosted, the controller 90 closes the first open-close device 9*b* corresponding to the parallel heat exchanger 51 to be defrosted. Furthermore, the controller 90 opens the second open-close device 10*b* and opens the flow control device 11. The controller 90 also opens the first open-close device 9*a* corresponding to the parallel heat exchanger 50 functioning as an evaporator and closes the second open-close device 10*a*. Consequently, the heating-defrosting operation mode is executed by opening a defrost circuit obtained by sequentially connecting the compressor 1, the flow control device 11, the second open-close device 10*b*, the parallel heat exchanger 51, and the second pressure reducing device 8*b*.

When the heating-defrosting operation mode is executed, a portion of the high-temperature high-pressure gas refrigerant discharged from the compressor 1 flows into the bypass pipe 37 and the pressure thereof is reduced to middle pressure by the flow control device 11. The change in refrigerant in this case is represented by the change from point (b) to point (e) in FIG. 9. The refrigerant the pressure of which is reduced to middle pressure indicated by point (e) flows through the second open-close device 10*b* and flows into the parallel heat exchanger 51. The refrigerant that has flowed into the parallel heat exchanger 51 is cooled by exchanging heat with frost formed on the parallel heat exchanger 51. In this manner, the frost formed on the parallel heat exchanger 51 can be melted by causing the high-temperature high-pressure gas refrigerant discharged from the compressor 1 to flow into the parallel heat exchanger 51. The change in refrigerant in this case is represented by the change from point (e) to point (f) in FIG. 9.

The refrigerant with which defrosting has been performed and that has flowed out from the parallel heat exchanger 51 passes through the second pressure reducing device 8*b*, so that the pressure thereof is reduced. The change in refrigerant in this case is represented by the change from point (f) to point (g) in FIG. 9. The refrigerant that has passed through the second pressure reducing device 8*b* merges with that in the main circuit 12. The resulting refrigerant passes through the second pressure reducing device 8*a*, flows into the parallel heat exchanger 50 functioning as an evaporator, and evaporates.

Here, the effects of pressure reduction performed by the flow control device 11 and the second pressure reducing device 8*b* will be described. The refrigerant discharged from the compressor 1 is high in pressure, and is thus in a state in which the saturation temperature is high. When refrigerant having a high saturation temperature flows into the parallel heat exchanger 51 to be defrosted, the refrigerant condenses quickly because the temperature difference from the melting temperature of frost (0 degrees Celsius) is large. As a result, the amount of liquid refrigerant present inside the parallel heat exchanger 51 increases and the amount of refrigerant to be used for heating becomes insufficient, and thus the heating capacity decreases. In a case where the heating load of the indoor space is heavy, the comfort of the indoor space thus decreases. Given these circumstances, the flow control device 11 reduces the pressure of the refrigerant discharged from the compressor 1 and causes the resulting refrigerant to flow into the parallel heat exchanger 51 to enable reduction of the saturation temperature and suppression of the amount of liquid refrigerant in the parallel heat exchanger 51 as in the air-conditioning apparatus 100 of Embodiment 1, so that the comfort of the indoor space can be improved.

In a case where the second pressure reducing device 8*b* is absent that reduces the pressure of refrigerant subjected to defrosting, the pressure of refrigerant to be used in defrosting is the same low pressure as that of refrigerant to be taken into the compressor 1. To cause the parallel heat exchangers 50 and 51 to frost over, when the parallel heat exchangers 50 and 51 function as an evaporator, the saturation temperature of the refrigerant inside needs to be less than or equal to 0 degrees Celsius, and the saturation temperature of refrigerant to be taken into the compressor 1 also becomes less than or equal to 0 degrees Celsius. In a case where the pressure of refrigerant in the parallel heat exchanger 51 to be defrosted is low and the saturation temperature is less than or equal to 0 degrees Celsius, the temperature of the refrigerant is lower than the melting temperature of frost (0 degrees Celsius), and thus the refrigerant does not condense and defrosting is performed using only sensible heat of gas refrigerant having a small quantity of heat. In this case, the amount of flow of refrigerant flowing into the parallel heat exchanger 51 needs to be increased to ensure the heating capacity, the amount of flow of refrigerant to be used for heating decreases, and consequently the heating capacity decreases, which is a factor causing a reduction in comfort. In the air-conditioning apparatus of Embodiment 1, since the second pressure reducing device 8*b* is provided, the pressure of refrigerant of the parallel heat exchanger 51 can be made to have a higher pressure range than the pressure of refrigerant to be taken into the compressor 1 and can be greater than or equal to 0 degrees Celsius when converted into saturation temperature, and latent heat having a large amount of heat can be used for defrosting. Thus, the comfort of the indoor space can be improved.

[Control Flow Chart]

Figure 10:
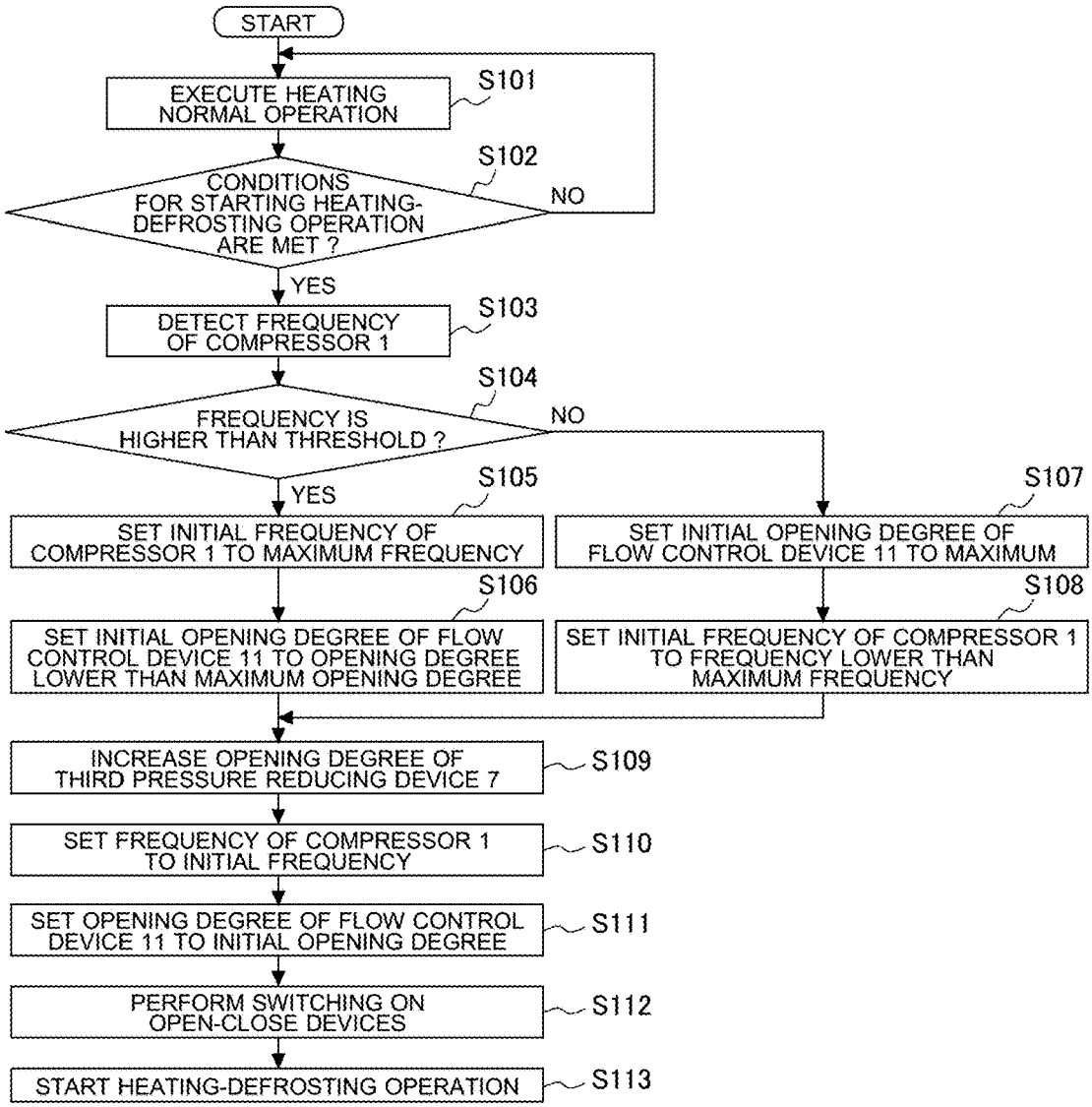
FIG. 10 is a control flow chart at the time of switching from the heating normal operation mode to the heating-defrosting operation mode in the air-conditioning apparatus according to Embodiment 1.

FIG. 10 is a control flow chart at the time of switching from the heating normal operation mode to the heating-defrosting operation mode in the air-conditioning apparatus according to Embodiment 1. First, in step S101, the controller 90 executes the heating normal operation mode. In step S102, during execution of the heating normal operation mode, the controller 90 determines whether the conditions for starting the heating-defrosting operation mode are met. In a case where the conditions for starting the heating-defrosting operation mode are not met, the process returns to step S101, and the controller 90 continues the heating normal operation mode. In contrast, in a case where the conditions for starting the heating-defrosting operation mode are met, the controller 90 allows the process to proceed to step S103.

In step S103, the controller 90 detects the frequency of the compressor 1 to determine a determination method for the initial frequency of the compressor 1 and the initial opening degree of the flow control device 11. In step S104, the controller 90 determines whether the detected frequency is higher than a threshold. In a case where the controller 90 determines in step S104 that the frequency is higher than the threshold, the process proceeds to step S105. In a case where it is determined that the frequency is less than or equal to the threshold, the process proceeds to step S107.

In step S105, the controller 90 sets the initial frequency of the compressor 1 to a predetermined maximum frequency. In step S106, the controller 90 sets the initial opening degree of the flow control device 11 to an opening degree lower than a predetermined maximum opening degree, and the process proceeds to step S109. Control performed in these steps S105 and S106 corresponds to an initial control mode 1. Note that the predetermined maximum frequency is a unique maximum value as an example. The predetermined maximum opening degree is a unique maximum value as an example.

In contrast, in step S107, the controller 90 sets the initial opening degree of the flow control device 11 to the predetermined maximum opening degree. In step S108, the controller 90 sets the initial frequency of the compressor 1 to a frequency lower than the predetermined maximum frequency, and the process proceeds to step S109. Control performed in these steps S107 and S108 corresponds to an initial control mode 2. Note that the predetermined maximum frequency is a unique maximum value as an example. The predetermined maximum opening degree is a unique maximum value as an example.

In step S109, the controller 90 increases the opening degree of the third pressure reducing device 7 and causes refrigerant in the receiver 6 to flow out. In step S110, the controller 90 performs control such that the frequency of the compressor 1 is set to the initial frequency. In step S111, the controller 90 performs control such that the opening degree of the flow control device 11 is set to the initial opening degree. In step S112, the controller 90 switches the state of the first open-close devices 9*a* and 9*b* and the second open-close devices 10*a* and 10*b* to that for the heating-defrosting operation mode. In step S113, the controller 90 starts the heating-defrosting operation mode.

Next, the effects of control steps S103 to S108 for calculating the initial frequency of the compressor 1 and the initial opening degree of the flow control device 11 will be described. The heating load of the indoor space can be estimated from the frequency of the compressor 1 that is in the heating normal operation mode. In a case where the frequency is high, the heating load is estimated to be heavy, and in a case where the frequency is low, the heating load is estimated to be light. The heating capacity for handling the heating load is determined by the amount of flow of refrigerant flowing through the load side heat exchangers 3*b* and 3*c*. In the heating-defrosting operation mode, a portion of the amount of flow of the refrigerant discharged from the compressor 1 is caused to flow through the flow control device 11 to melt frost formed on the parallel heat exchangers 50 and 51 to be defrosted, and the rest of the amount of flow of the refrigerant is caused to flow through the load side heat exchangers 3*b* and 3*c* to be used to heat the indoor space.

Thus, in a case where the frequency of the compressor 1 is high during the heating normal operation mode, the amount of flow through the flow control device 11 needs to be reduced and the amounts of flow through the load side heat exchangers 3*b* and 3*c* need to be increased. In contrast, in a case where the frequency of the compressor 1 is low during the heating normal operation mode, the amount of flow through the flow control device 11 needs to be increased and the amounts of flow through the load side heat exchangers 3*b* and 3*c* need to be reduced. The amount of flow through the flow control device 11 can be adjusted by controlling the opening degree of the flow control device 11. Consequently, the amounts of flow through the load side heat exchangers 3*b* and 3*c* can be adjusted, and the heating capacity can be adjusted in accordance with the heating load of the indoor space.

Thus, in a case where the heating-defrosting operation mode is started in a state where the frequency of the compressor 1 detected in step S103 during the heating normal operation mode is high and the heating load of the indoor space is heavy, the comfort of the indoor space can be maintained by setting the frequency of the compressor 1 to the predetermined maximum frequency to maximize the amount of flow of the refrigerant to be discharged from the compressor 1 and by the flow control device 11 adjusting the heating capacity to match the heating load of the indoor space as in steps S105 and S106.

However, refrigerant that is in a gas state flows through the flow control device 11, and thus the flow path needs to be large to enable a large amount of refrigerant to flow. Even in a case where the frequency of the compressor 1 detected in step S103 during the heating normal operation mode is low and the heating load of the indoor space is almost zero, to adjust the heating capacity to an appropriate heating capacity using only the flow control device 11, the flow control device 11 needs to be increased in size. There is also a method for making it harder for refrigerant to flow through the load side heat exchangers 3*b* and 3*c* by, for example, reducing the opening degree of the first pressure reducing device 4. However, in a case where the flow control device 11 is small and the opening degree of the first pressure reducing device 4 is fully closed, the discharge pressure of the compressor 1 increases, and operation may be stopped to protect the air-conditioning apparatus 100 or the air-conditioning apparatus 100 may fail. Thus, in a case where the flow control device 11 is small, the heating capacity of the indoor space cannot be reduced only by the flow control device 11, so that the temperature of the indoor space increases and the comfort of the indoor space decreases.

Thus, in a case where the frequency of the compressor 1 detected in step S103 during the heating normal operation mode is low, not only is the initial opening degree of the flow control device 11 set to the maximum in step S107 but the initial frequency of the compressor 1 is also set to a frequency lower than the predetermined maximum frequency in step S108. Consequently, even in a case where the flow control device 11 is small, the amounts of flow through the load side heat exchangers 3*b* and 3*c* are reduced without increasing the discharge pressure of the compressor 1 by reducing the amount of flow discharged from the compressor 1, so that the heating capacity can be reduced and the comfort of the indoor space can be improved.

Note that although the initial opening degree of the flow control device 11 in step S106 or the initial frequency of the compressor 1 in step S108 may have a fixed value, the heating capacity can be adjusted to the capacity corresponding to the heating load of the indoor space by changing the opening degree of the flow control device 11 or the frequency of the compressor 1 in accordance with the frequency of the compressor 1 detected in step S103 during the heating normal operation mode, and the comfort of the indoor space can be improved. The higher the frequency of the compressor 1, the heavier the heating load of the indoor space, and thus the higher the frequency of the compressor 1 detected in step S103 during the heating normal operation mode, the lower the initial opening degree of the flow control device 11 that is set in step S106 and the higher the initial frequency of the compressor 1 that is set in step S108.

Next, the effects of control step S109, in which the third pressure reducing device 7 is opened, will be described. To perform defrosting at the parallel heat exchanger 51 using latent heat, a greater amount of refrigerant is needed than in the case where the parallel heat exchanger 51 functions as an evaporator. In the heating normal operation mode, a portion of refrigerant that does not contribute to heating of the indoor space is stored in the form of liquid in the receiver 6, the amount of refrigerant stored increases or decreases in accordance with the opening degree of the third pressure reducing device 7, and the amount of refrigerant stored decreases when the stored liquid refrigerant is released by increasing the degree of opening. Thus, by opening the third pressure reducing device 7 before switching the mode from the heating normal operation mode to the heating-defrosting operation mode, the amount of refrigerant in the parallel heat exchanger 51 can be increased through the release of the refrigerant stored in the receiver 6, and defrosting using latent heat can be quickly started.

Note that although a change in the opening degree of the third pressure reducing device 7 before switching the mode from the heating normal operation mode to the heating-defrosting operation mode may be a fixed value, the change may be changed in accordance with the frequency of the compressor 1 detected in step S103 during the heating normal operation mode. In a case where the frequency of the compressor 1 is low, the amount of flow of refrigerant flowing in the refrigerant circuit is small, and the amount of refrigerant flowing out from the receiver 6 is also small. Thus, the lower the frequency of the compressor 1, the more greatly the opening degree of the third pressure reducing device 7 that is changed. As a result, the amount of refrigerant flowing out from the receiver 6 is increased, and refrigerant can be made to move quickly.

Note that, in the flow chart illustrated in FIG. 10, after setting the initial frequency of the compressor 1 and the initial opening degree of the flow control device 11 (steps S103 to S108), operation is performed in the order of the third pressure reducing device 7 (step S109), the compressor 1 (step S110), and the flow control device 11 (step S111), however, the operation is not necessarily performed in this order. For example, the initial frequency of the compressor 1 and the initial opening degree of the flow control device 11 may be set after increasing the opening degree of the third pressure reducing device 7, and operation may be performed in the order of the flow control device 11 and the compressor 1.

Figure 11:
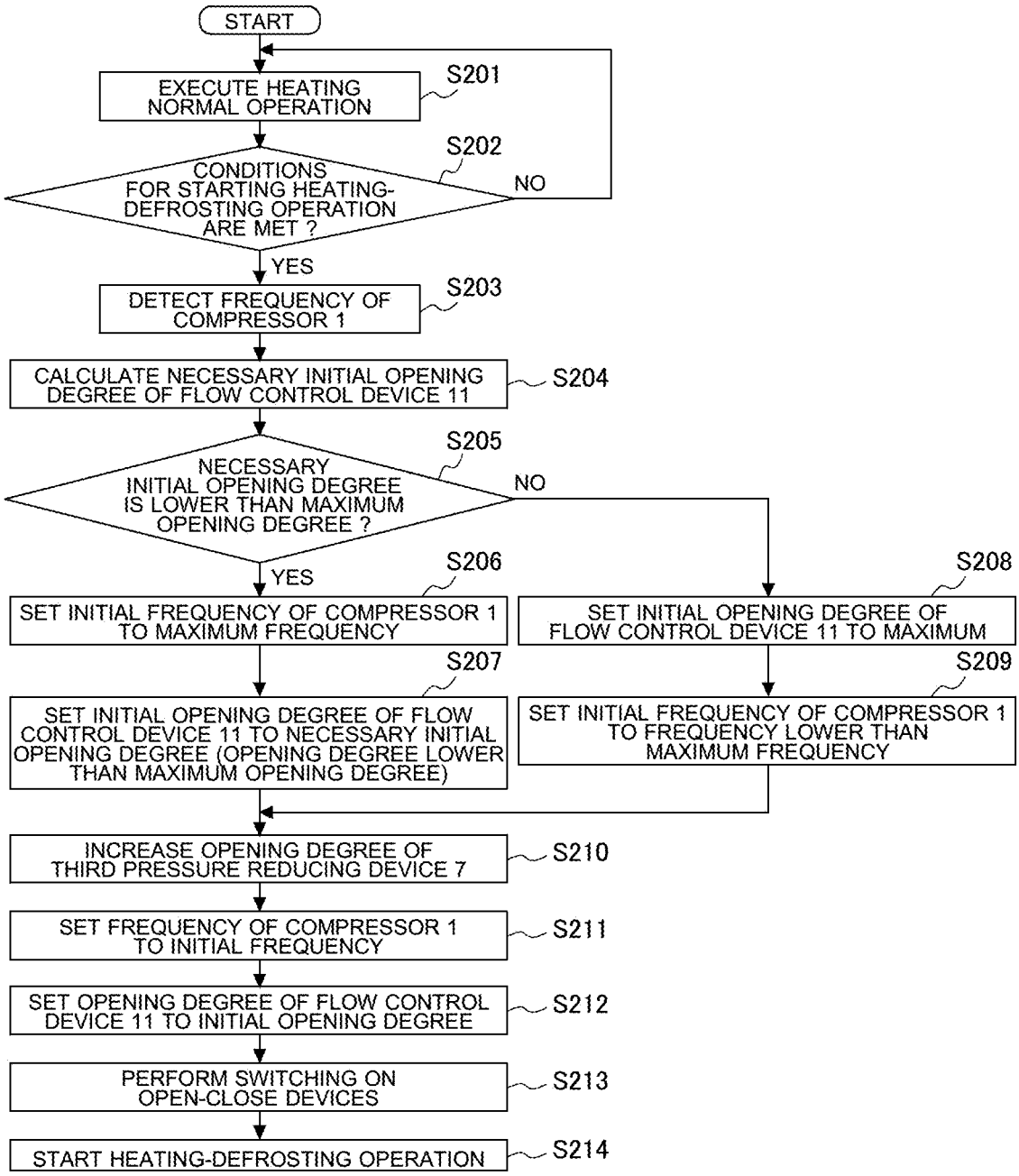
FIG. 11 is a control flow chart for another embodiment at the time of switching from the heating normal operation mode to the heating-defrosting operation mode in the air-conditioning apparatus according to Embodiment 1.

FIG. 11 is a control flow chart for another embodiment at the time of switching from the heating normal operation mode to the heating-defrosting operation mode in the air-conditioning apparatus according to Embodiment 1. In the following, regarding the control flow chart illustrated in FIG. 11, different portions from the control flow chart illustrated in FIG. 10 will be mainly described.

Steps S201 to S202 illustrated in FIG. 11 are the same as steps S101 to S102 of FIG. 10. In step S203, the controller 90 detects the frequency of the compressor 1 in the heating normal operation mode. In step S204, in a case where it is assumed that the frequency of the compressor 1 is increased to the predetermined maximum frequency, the controller 90 calculates, on the basis of the detected frequency, a necessary initial opening degree of the flow control device 11 needed to achieve the heating capacity corresponding to the heating load of the indoor space. In step S205, the controller 90 compares the calculated necessary initial opening degree with the predetermined maximum opening degree. Note that, in step S205, a case where the necessary initial opening degree is lower than the predetermined maximum opening degree corresponds to step S104 of FIG. 10 in which the frequency is higher than the threshold. In step S205, a case where the necessary initial opening degree is greater than the predetermined maximum opening degree corresponds to step S104 of FIG. 10 in which the frequency is lower than the threshold. Steps S206 to S214 are the same as steps S105 to S113 illustrated in FIG. 10.

As described above, when the frequency of the compressor 1 detected in step S203 in the heating normal operation mode is low, it is estimated in step S204 that the heating load of the indoor space is light, and calculation is performed such that the necessary initial opening degree of the flow control device 11 is increased to increase the amount of flow of refrigerant flowing in the flow control device 11. Thus, when the frequency of the compressor 1 detected in step S203 in the heating normal operation mode is lower than a certain value, the necessary initial opening degree of the flow control device 11 calculated in step S204 always has a greater value than the maximum opening degree. The initial control mode 2 for executing steps S208 and S209 is selected through the comparison performed in step S205, and control substantially the same as the comparison performed in step S104 illustrated in FIG. 10 can be performed.

Note that, in the control flow chart illustrated in FIG. 11, after setting the initial frequency of the compressor 1 and the initial opening degree of the flow control device 11 (steps S203 to S209), operation is performed in the order of the third pressure reducing device 7 (step S210), the compressor 1 (step S211), and the flow control device 11 (step S212); however, the operation is not necessarily performed in this order. For example, the initial frequency of the compressor 1 and the initial opening degree of the flow control device 11 may be set after increasing the opening degree of the third pressure reducing device 7, and operation may be performed in the order of the flow control device 11 and the compressor 1.

Embodiment 2

Figure 12:
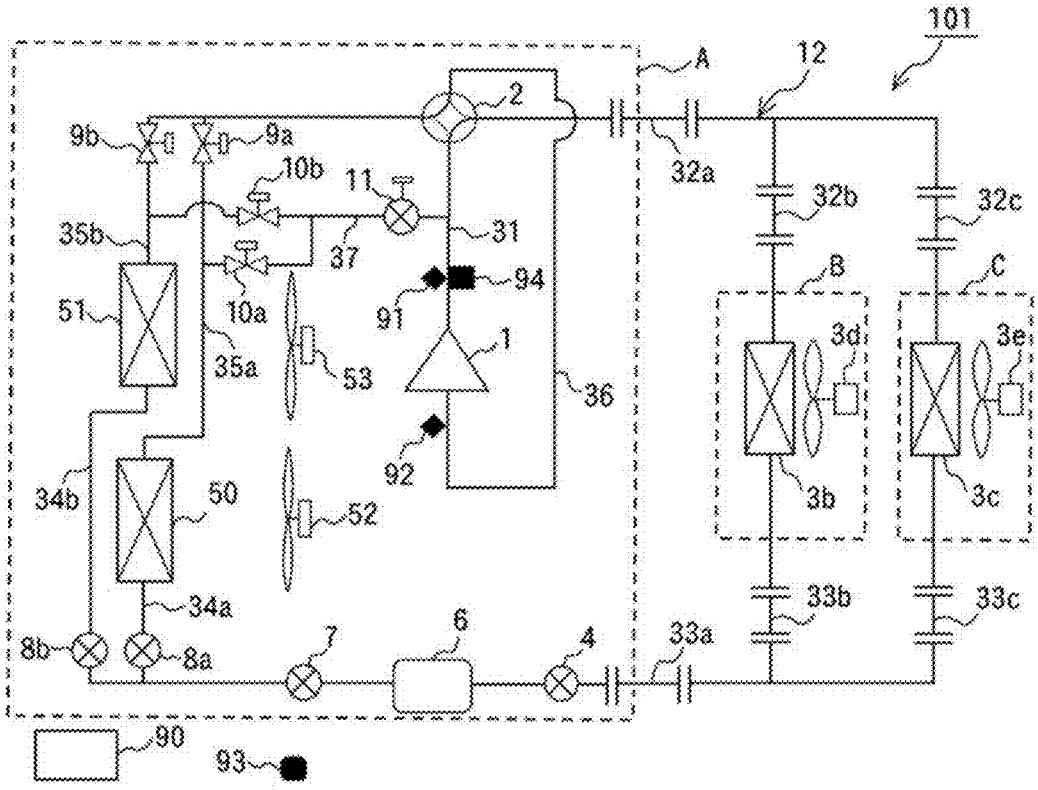
FIG. 12 is a refrigerant circuit diagram of an air-conditioning apparatus according to Embodiment 2.

Next, with reference to FIGS. 12 to 14, an air-conditioning apparatus 101 according to Embodiment 2 will be described. FIG. 12 is a refrigerant circuit diagram of an air-conditioning apparatus according to Embodiment 2. In the following, portions of the air-conditioning apparatus 101 different from those of Embodiment 1 will be mainly described, and detailed description of the configurations substantially the same as those of Embodiment 1 will be omitted.

As illustrated in FIG. 12, the air-conditioning apparatus 101 according to Embodiment 2 is provided with a discharge pressure detector 91 configured to detect the discharge pressure of the compressor 1, a suction pressure detector 92 configured to detect the suction pressure of the compressor 1, an outdoor temperature detector 93 configured to detect the temperature of air around the outdoor unit A, and a discharge temperature detector 94 configured to detect the discharge temperature of the compressor 1 in addition to the configuration of the air-conditioning apparatus 100 of Embodiment 1. The discharge pressure detector 91 is a discharge pressure sensor. The suction pressure detector 92 is a suction pressure sensor. The outdoor temperature detector 93 is an outdoor temperature sensor. The discharge temperature detector 94 is a discharge temperature sensor.

Note that the discharge pressure detector 91 and the discharge temperature detector 94 are provided at the discharge pipe 31. The suction pressure detector 92 is provided at the suction pipe 36. Note that the installation positions of the individual sensors are not limited to these positions. For example, it is sufficient that the discharge pressure detector 91 and the discharge temperature detector 94 can detect the pressure of refrigerant that is substantially the same as the discharge pressure of the compressor 1 in the heating operation, and may be installed between the cooling-heating switching device 2 and the load side heat exchangers 3*b* and 3*c*. Moreover, at a portion of the load side heat exchangers 3*b* and 3*c* where refrigerant enters a two-phase gas-liquid state, the discharge pressure detector 91 may have, instead of the pressure sensor, a temperature sensor as a discharge temperature detector that can detect the temperature of refrigerant, and may treat a value detected by the discharge temperature detector as a refrigerant saturation temperature and convert the refrigerant saturation temperature into the pressure of refrigerant. It is sufficient that the suction pressure detector 92 can detect the pressure of refrigerant that is substantially the same as the suction pressure of the compressor 1 in the heating operation, and the suction pressure detector 92 may be installed between the first open-close devices 9*a* and 9*b* and the cooling-heating switching device 2. Furthermore, the suction pressure detector 92 may also be installed between the second pressure reducing device 8*a* and the first open-close device 9*a* and between the second pressure reducing device 8*b* and the first open-close device 9*b*. Moreover, at a pipe portion where refrigerant enters a two-phase state, the discharge pressure detector 91 and the suction pressure detector 92 may have, instead of the discharge pressure sensor and the suction pressure sensor, a temperature sensor that can detect the temperature of refrigerant, and may treat a value detected by the temperature sensor as a refrigerant saturation temperature and convert the refrigerant saturation temperature into the pressure of refrigerant.

In the air-conditioning apparatus 101 according to Embodiment 2, the third pressure reducing device 7 is controlled during the heating normal operation mode to perform an adjustment such that the discharge temperature detected by the discharge temperature detector 94 becomes a constant value. The discharge temperature can be reduced when the refrigerant stored in the receiver 6 is released by opening the third pressure reducing device 7 and two-phase gas-liquid refrigerant the quality of which is low is taken into the compressor 1. A target discharge temperature may be changed in accordance with the discharge pressure detected by the discharge pressure detector 91, the suction pressure detected by the suction pressure detector 92, and the outdoor temperature detected by the outdoor temperature detector 93. Consequently, an adjustment to an appropriate discharge temperature matching an actual operation can be performed.

[Control Flow Chart]

Figure 13:
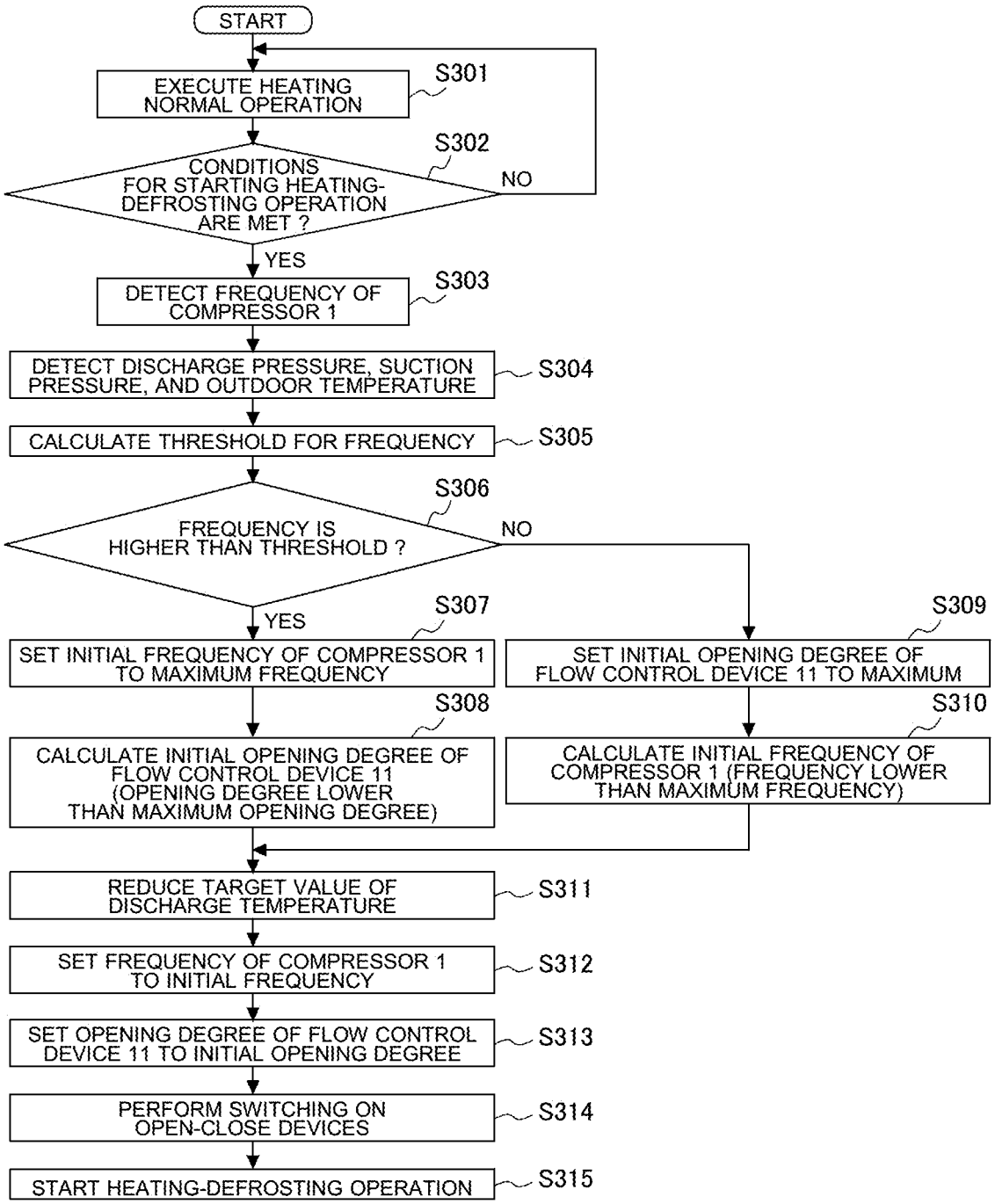
FIG. 13 is a control flow chart at the time of switching from the heating normal operation mode to the heating-defrosting operation mode in the air-conditioning apparatus according to Embodiment 2.
Figure 14:
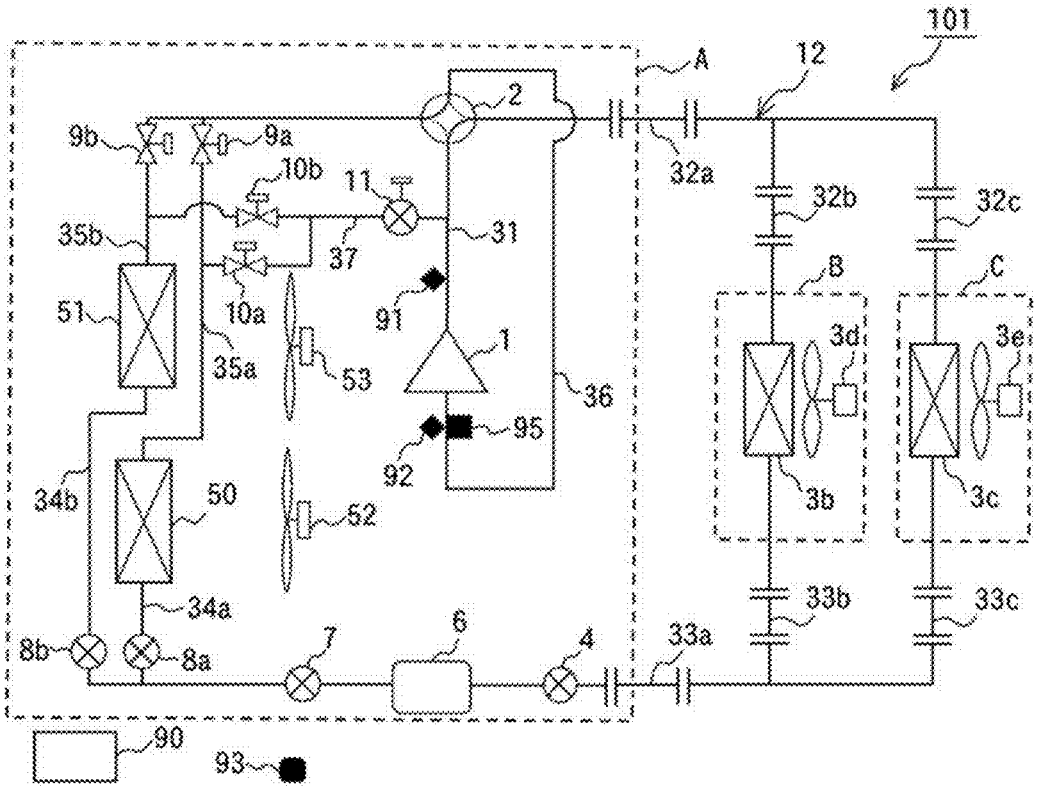
FIG. 14 is a refrigerant circuit diagram illustrating an example of a modification of the air-conditioning apparatus according to Embodiment 2.

FIG. 13 is a control flow chart at the time of switching from the heating normal operation mode to the heating-defrosting operation mode in the air-conditioning apparatus according to Embodiment 2. Note that, in the following description, different portions from the control flow chart of Embodiment 1 described above will be described.

Steps S301 to S302 are the same as steps S101 to S102 illustrated in FIG. 10. In a case where the conditions for starting the heating-defrosting operation are met, in step S303, the controller 90 detects the frequency of the compressor 1 to determine a determination method for the initial frequency of the compressor 1 and the initial opening degree of the flow control device 11. Next, in step S304, the controller 90 detects a discharge pressure, a suction pressure, and an outdoor temperature using the discharge pressure detector 91, the suction pressure detector 92, and the outdoor temperature detector 93. Next, in step S305, the controller 90 calculates a threshold for the frequency from the detected discharge pressure, suction pressure, and outdoor temperature.

In step S306, the controller 90 determines whether the detected frequency is greater than the calculated threshold. In a case where the controller 90 determines in step S306 that the frequency is greater than the threshold, the process proceeds to step S307. In a case where it is determined that the frequency is less than or equal to the threshold, the process proceeds to step S309.

In step S307, the controller 90 sets the initial frequency of the compressor 1 to a predetermined maximum frequency. In step S308, the controller 90 sets the initial opening degree of the flow control device 11 to an opening degree lower than a predetermined maximum opening degree, and the process proceeds to step S311. Control performed in these steps S307 and S308 corresponds to the initial control mode 1. Note that the predetermined maximum frequency is a unique maximum value as an example. The predetermined maximum opening degree is a unique maximum value as an example.

In contrast, in step S309, the controller 90 sets the initial opening degree of the flow control device 11 to the predetermined maximum opening degree. In step S310, the controller 90 sets the initial frequency of the compressor 1 to a frequency lower than the predetermined maximum frequency, and the process proceeds to step S311. Control performed in these steps S309 and S310 corresponds to the initial control mode 2. Note that the predetermined maximum frequency is a unique maximum value as an example. The predetermined maximum opening degree is a unique maximum value as an example.

In step S311, the controller 90 sets a target value of the discharge temperature, which is a target to be controlled by the third pressure reducing device 7, to be smaller than that at the time of the heating normal operation mode before starting the heating-defrosting operation mode. Consequently, the third pressure reducing device 7 is opened to reduce the discharge temperature, and thus effects similar to those of control step S109 or S210, in which the opening degree of the third pressure reducing device 7 is increased in Embodiment 1, can be obtained. Note that steps S312 to S315 are the same as steps S110 to S113 illustrated in FIG. 10.

Next, the effects of control steps S304 to S305 will be described, in which the threshold for the frequency is calculated from the discharge pressure, the suction pressure, and the outdoor temperature. In steps S307 and S308, which correspond to a control method for adjusting the heating capacity in accordance with the opening degree of the flow control device 11, the amounts of refrigerant flowing through the load side heat exchangers 3*b* and 3*c* are changed to adjust the heating capacity by adjusting what percentage of the amount of flow of the refrigerant discharged from the compressor 1 is caused to flow through the flow control device 11. In a case where the flow control device 11 is fully opened, the amount of flow through the flow control device 11 reaches a maximum and the amounts of flow through the load side heat exchangers 3*b* and 3*c* reach a minimum, and thus the heating capacity reaches a minimum. Thus, in a case where the maximum amount of flow through the flow control device 11 decreases or the amount of flow of the refrigerant discharged from the compressor 1 increases, the minimum amounts of flow through the load side heat exchangers 3*b* and 3*c* increase, and thus the minimum heating capacity increases. In a case where the heating load of the indoor space is light, the heating capacity is thus excessive. Therefore, in a case where the maximum amount of flow through the flow control device 11 decreases or the amount of flow of the refrigerant discharged from the compressor 1 increases, steps S309 and S310 need to be used, which correspond to the control method for adjusting the heating capacity in accordance with the frequency of the compressor 1.

The maximum amount of flow that can be achieved in a case where the flow control device 11 is set to have the predetermined maximum opening degree is determined by the difference in pressure across the flow control device 11. The smaller the difference in pressure across the flow control device 11 is, the smaller the maximum amount of flow becomes. Thus, the lower the upstream-side pressure of the flow control device 11, which is the discharge pressure, the smaller the frequency threshold calculated in step S305 and the wider the range corresponding to steps S309 and S310, so that control matching an actual operation can be performed.

When the same frequency is used, the higher the suction pressure is, the greater the amount of flow of the refrigerant discharged from the compressor 1 becomes. Thus, the higher the suction pressure, the smaller the frequency threshold calculated in step S305 and the wider the range corresponding to steps S309 and S310, so that control matching an actual operation can be performed.

The suction pressure during the heating operation changes with outdoor temperature, and the higher the outdoor temperature, the higher the suction pressure. Thus, in a case where the outdoor temperature is high, it is assumed that the suction pressure is high, and the frequency threshold calculated in step S305 is reduced.

As described above, by performing control using the discharge pressure detector 91, the suction pressure detector 92, and the outdoor temperature detector 93, the air-conditioning apparatus 101 according to Embodiment 2 can control the heating capacity at the time of the heating-defrosting operation mode in accordance with the actual operation state, and an improvement in comfort can be achieved.

Furthermore, the initial opening degree of the flow control device 11 in step S308 and the initial frequency in step S310 are determined on the basis of the frequency of the compressor 1 detected in step S303 or any one value or more out of the discharge pressure, the suction pressure, or the outdoor temperature detected in step S304. Consequently, an adjustment to the heating capacity corresponding to the heating load of the indoor space in the actual operation can be made, and the comfort of the indoor space can be improved.

Note that, in the control flow chart illustrated in FIG. 13, the control method is changed on the basis of the frequency of the compressor 1 as in the control flow chart of FIG. 10 in Embodiment 1; however, the necessary initial opening degree of the flow control device 11 may be calculated as in the control flow chart of FIG. 11 in Embodiment 1, and the control method may be changed on the basis of the necessary initial opening degree. Specifically, after detecting the frequency of the compressor 1 and the discharge pressure, the suction pressure, and the outdoor temperature in steps S303 and S304, the necessary initial opening degree of the flow control device 11 is calculated in step S305. The necessary initial opening degree is a degree of opening needed to achieve the heating capacity corresponding to the heating load in a case where it is assumed that the frequency of the compressor 1 is increased to the predetermined maximum frequency on the basis of the detected frequency. Next, in step S306, the control method is determined by comparing the calculated necessary initial opening degree with the predetermined maximum opening degree. Even in this method, by changing the necessary initial opening degree in accordance with not only the frequency of the compressor 1 detected in step S303 but also the discharge pressure, the suction pressure, and the outdoor temperature detected in step S304, control can be performed that is equivalent to that in the case where the control method is changed on the basis of the frequency of the compressor 1. In this case, the lower the frequency, the lower the discharge pressure, the higher the suction pressure, or the higher the outdoor temperature, the greater the necessary initial opening degree that is set.

Note that all of the discharge pressure detector 91, the suction pressure detector 92, and the outdoor temperature detector 93 are not necessarily provided, and one or two out of the detectors may be installed and a threshold may be determined from detection values from the installed sensors.

Note that, in Embodiment 2, the case has been described in which the discharge temperature detected by the discharge temperature detector 94 is adjusted by controlling the third pressure reducing device 7; however, what is adjusted is not limited to this. The discharge temperature detector 94 and the discharge pressure detector 91 may be used as a first degree-of-superheat detector configured to detect the degree of superheat of the refrigerant discharged from the compressor 1, and the degree of discharge superheat calculated from the discharge temperature detected by the discharge temperature detector 94 and the discharge pressure detected by the discharge pressure detector 91 may be adjusted by controlling the third pressure reducing device 7. FIG. 14 is a refrigerant circuit diagram illustrating an example of a modification of the air-conditioning apparatus 101 according to Embodiment 2. As illustrated in FIG. 14, a suction temperature detector 95 configured to detect the temperature of refrigerant to be taken into the compressor 1 may be provided at substantially the same position as that of the suction pressure detector 92, and the suction temperature may be adjusted by controlling the third pressure reducing device 7. Moreover, the suction temperature detector 95 and the suction pressure detector 92 may be used as a second degree-of-superheat detector configured to detect the degree of superheat of the refrigerant to be taken into the compressor 1, and the degree of suction superheat calculated from the suction temperature detected by the suction temperature detector 95 and the suction pressure detected by the suction pressure detector 92 may be adjusted by controlling the third pressure reducing device 7. In any of the control methods, effects similar to those of control step S109 or step S210 of Embodiment 1, in which the opening degree of the third pressure reducing device 7 is increased, can be obtained by setting the target value to be smaller than that at the time of the heating normal operation mode in a control step corresponding to step S311.

Embodiment 3

Figure 15:
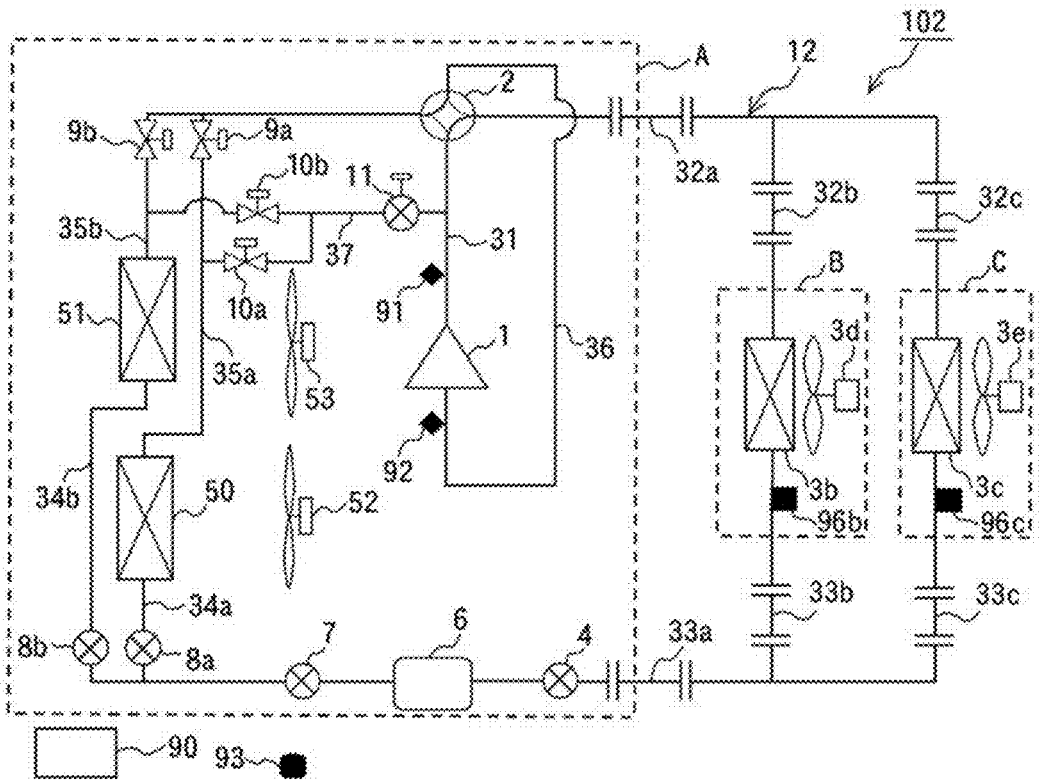
FIG. 15 is a refrigerant circuit diagram of an air-conditioning apparatus according to Embodiment 3.

Next, with reference to FIGS. 15 to 16, an air-conditioning apparatus 102 according to Embodiment 3 will be described. FIG. 15 is a refrigerant circuit diagram of an air-conditioning apparatus according to Embodiment 3. In the following, portions of the air-conditioning apparatus 101 different from those of Embodiment 1 will be mainly described, and detailed description of the configurations substantially the same as those of Embodiment 1 will be omitted.

As illustrated in FIG. 15, the air-conditioning apparatus 102 according to Embodiment 3 is provided with the discharge pressure detector 91 configured to detect the discharge pressure of the compressor 1, the outdoor temperature detector 93 configured to detect the temperature of air around the outdoor unit A, an indoor liquid temperature sensor 96*b* configured to detect the temperature of refrigerant at an outlet of the load side heat exchanger 3*b* in the heating operation, and an indoor liquid temperature sensor 96*c* configured to detect the temperature of refrigerant at an outlet of the load side heat exchanger 3*c* in the heating operation in addition to the configuration of the air-conditioning apparatus 100 of Embodiment 1. A degree-of-subcooling detector includes the discharge pressure detector 91 and the indoor liquid temperature sensors 96*b* and 96*c*. Note that the installation positions of the indoor liquid temperature sensors 96*b* and 96*c* are not limited to those illustrated in the drawing. It is sufficient that the indoor liquid temperature sensors 96*b* and 96*c* can detect the temperatures of refrigerant substantially the same as the temperatures at the outlets of the load side heat exchangers 3*b* and 3*c* in the heating operation, and the indoor liquid temperature sensors 96*b* and 96*c* may also be installed at the second extension pipe 33*a* of the outdoor unit A.

[Control Flow Chart]

Figure 16:
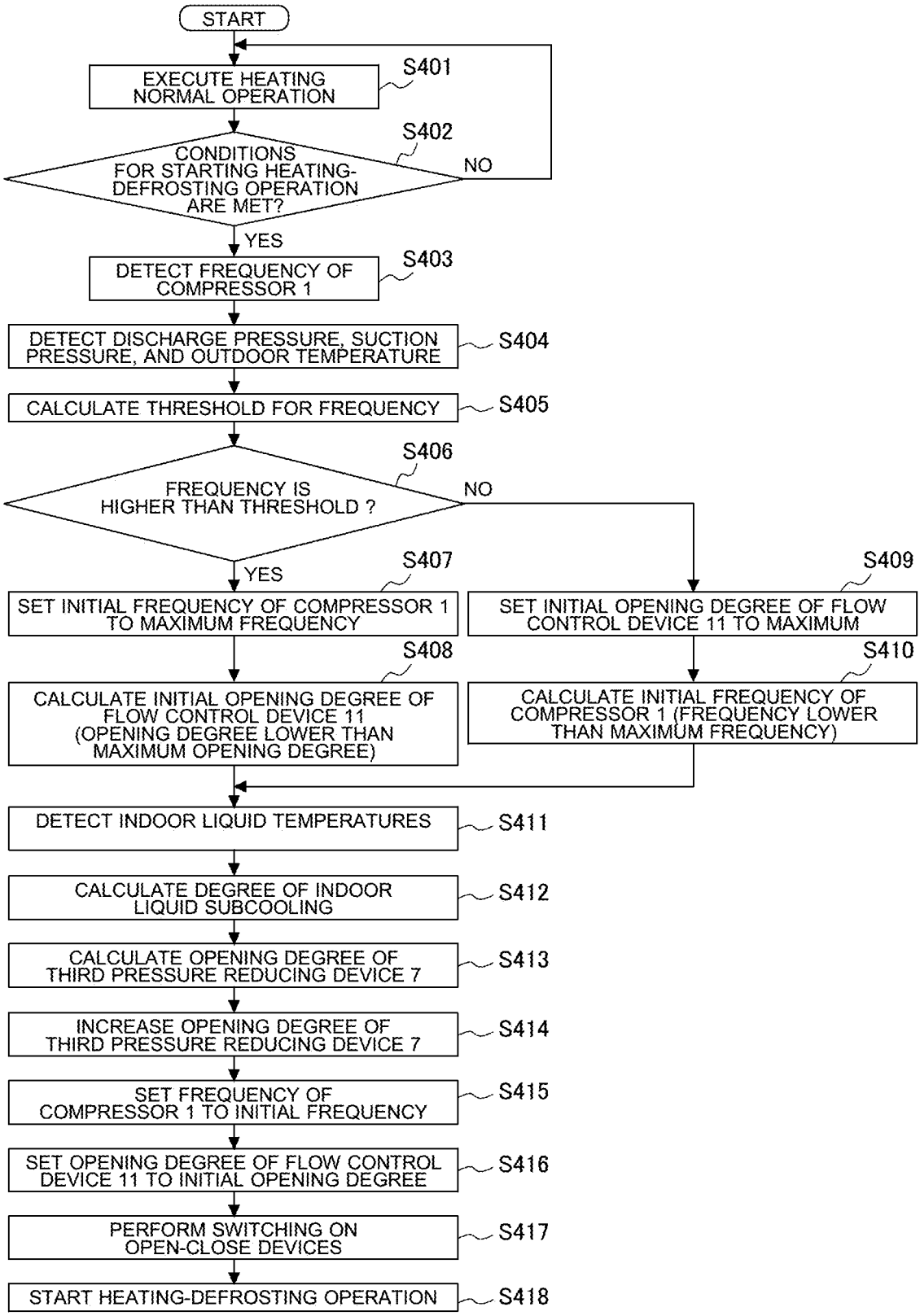
FIG. 16 is a control flow chart at the time of switching from the heating normal operation mode to the heating-defrosting operation mode in the air-conditioning apparatus according to Embodiment 3.

FIG. 16 is a control flow chart at the time of switching from the heating normal operation mode to the heating-defrosting operation mode in the air-conditioning apparatus according to Embodiment 3. Note that, in the following description, different portions from the control flow chart of Embodiment 2 described above will be described.

Steps S401 to S410 are the same as steps S301 to S310 illustrated in FIG. 13. In step S411, the controller 90 detects indoor liquid temperatures using the indoor liquid temperature sensors 96*b* and 96*c*. In step S412, the controller 90 calculates the degree of indoor liquid subcooling from the indoor liquid temperatures and the discharge pressure detected using the discharge pressure detector 91. The degree of indoor liquid subcooling is calculated from the difference between the saturation temperature of refrigerant converted from the discharge pressure and the indoor liquid temperatures. In step S413, the controller 90 calculates the opening degree of the third pressure reducing device 7 using the calculated degree of indoor liquid subcooling. In step S414, the controller 90 opens the third pressure reducing device 7 such that its opening degree reaches the calculated opening degree. Note that steps S415 to S418 are the same as steps S312 to S315 illustrated in FIG. 13.

Next, the effects of control steps S412 to S414 will be described in which the opening degree of the third pressure reducing device 7 is calculated from the degree of indoor liquid subcooling and the third pressure reducing device 7 is opened. The degree of indoor liquid subcooling is an indicator of the amount of liquid refrigerant present in the load side heat exchangers 3*b* and 3*c*. In a case where the degree of indoor liquid subcooling is low, the amount of liquid refrigerant present in the load side heat exchangers 3*b* and 3*c* is small. Liquid refrigerant that does not contribute to heating of the indoor space is stored in the receiver 6. Thus, when the degree of indoor liquid subcooling is low, the amount of liquid refrigerant in the receiver 6 is estimated to be large. In the air-conditioning apparatus 102 according to Embodiment 3, the opening degree at which the third pressure reducing device 7 is opened is determined in accordance with the magnitude of the degree of indoor liquid subcooling, and the lower the degree of indoor liquid subcooling is, the wider the third pressure reducing device 7 is opened. As a result, liquid refrigerant can be caused to flow out in accordance with the amount of refrigerant stored in the receiver 6, and defrosting using latent heat can be quickly started.

In the above, the air-conditioning apparatuses (100 to 102) have been described based on Embodiments 1 to 3; however, the air-conditioning apparatuses (100 to 102) are not limited to the configurations of Embodiments 1 to 3 described above. For example, the air-conditioning apparatuses 100 to 102 have been described using, as examples, the air-conditioning apparatuses in which the receiver 6 is provided upstream of the parallel heat exchangers 50 and 51 during the heating operation as a container for storing liquid refrigerant; however, the air-conditioning apparatuses 100 to 102 may be configured without the receiver 6. In addition, as a portion that controls the compressor 1 and the flow control device 11 during the heating-defrosting operation mode, an accumulator may be provided at a suction portion of the compressor 1. The air-conditioning apparatuses 100 to 102 have been described using, as examples, the air-conditioning apparatuses that perform switching between the cooling and heating operations; however, the air-conditioning apparatuses 100 to 102 do not necessarily use these air-conditioning apparatuses. An air-conditioning apparatus having a circuit configuration capable of performing a cooling-heating simultaneous operation can also be used. Moreover, the cooling-heating switching device 2 may be omitted, and the heating normal operation mode and the heating-defrosting operation mode may only be executed.

Moreover, the air-conditioning apparatuses 100 to 102 are not limited to the content described above and may also include other configuration elements. In short, the air-conditioning apparatuses (100 to 102) according to Embodiments 1 to 3 described above include design changes and application variations normally done by those skilled in the art without departing from their technical ideas.

REFERENCE SIGNS LIST

1: compressor, 2: cooling-heating switching device, 3*b*, 3*c*: load side heat exchanger, 3*d*, 3*e*: indoor fan, 4: first pressure reducing device, 5: heat source side heat exchanger, 5*a*: heat transfer pipe, 5*b*: fin, 6: receiver, 7: third pressure reducing device, 8*a*, 8*b*: second pressure reducing device, 9*a*, 9*b*: first open-close device, 10*a*, 10*b*: second open-close device, 11: flow control device, 12: main circuit, 31: discharge pipe, 32*a*, 32*b*, 32*c*: first extension pipe, 33*a*, 33*b*, 33*c*: second extension pipe, 34*a*, 34*b*: first connection pipe, 35*a*, 35*b*: second connection pipe, 36: suction pipe, 37: bypass pipe, 50, 51: parallel heat exchanger, 52, 53: outdoor fan, 90: controller, 91: discharge pressure detector, 92: suction pressure detector, 93: outdoor temperature detector, 94: discharge temperature detector, 95: suction temperature detector, 96*b*, 96*c*: indoor liquid temperature sensor, 100, 101, 102: air-conditioning apparatus, A: outdoor unit, B, C: indoor unit.

The invention claimed is:

1. An air-conditioning apparatus including an outdoor unit and an indoor unit connected to the outdoor unit with pipes interposed therebetween, the air-conditioning apparatus comprising:

a main circuit in which a compressor, a load side heat exchanger included in the indoor unit, a first pressure reducing device, and a plurality of parallel heat exchangers included in the outdoor unit and connected in parallel with each other are sequentially connected by the pipes and through which refrigerant circulates;

a bypass pipe diverting a portion of the refrigerant discharged from the compressor and causing the portion of the refrigerant to flow into the parallel heat exchangers;

a flow path switching device provided at the bypass pipe and selecting one or more parallel heat exchangers out of the plurality of parallel heat exchangers as a target to be defrosted;

a flow control device provided at the bypass pipe and adjusting an amount of flow of the refrigerant flowing in the bypass pipe; and a controller configured to control operation of the outdoor unit and the indoor unit, wherein the controller is configured to operate in a heating normal operation mode for causing each of the plurality of parallel heat exchangers to function as an evaporator and a heating-defrosting operation mode for treating the one or more parallel heat exchangers out of the plurality of parallel heat exchangers as the target to be defrosted and causing each other parallel heat exchanger out of the plurality of parallel heat exchangers to function as an evaporator, and in a case of switching from the heating normal operation mode to the heating-defrosting operation mode, the controller is configured to make a selection from an initial control mode 1 and an initial control mode 2 to execute the heating-defrosting operation mode, wherein in the initial control mode 1, control is performed such that an initial frequency of the compressor is set to a predetermined maximum frequency and an initial opening degree of the flow control device is set to an opening degree lower than a predetermined maximum opening degree, and in the initial control mode 2, control is performed such that the initial opening degree of the flow control device is set to the predetermined maximum opening degree and the initial frequency of the compressor is set to a frequency lower than the predetermined maximum frequency, to execute the heating-defrosting operation mode, and the controller selects either the initial control mode 1 or the initial control mode 2 based on a frequency of the compressor in the heating normal operation mode.

2. The air-conditioning apparatus of claim 1, wherein the controller selects the initial control mode 1 in a first condition that the frequency of the compressor in the heating normal operation mode is greater than a set threshold, and selects the initial control mode 2 in a second condition that the frequency of the compressor in the heating normal operation mode is less than or equal to the set threshold.

3. The air-conditioning apparatus of claim 2, further comprising:

a discharge pressure detector configured to detect a discharge pressure of refrigerant discharged from the compressor, a suction pressure detector configured to detect a suction pressure of refrigerant to be taken into the compressor, and an outdoor temperature detector configured to detect outdoor temperature, wherein the controller calculates the set threshold based on one value or more out of the discharge pressure, the suction pressure, and the outdoor temperature.

4. The air-conditioning apparatus of claim 3, wherein the controller sets the set threshold to a smaller value as the discharge pressure decreases, the suction pressure increases, or the outdoor temperature increases.

5. The air-conditioning apparatus of claim 3, wherein the controller determines the initial opening degree of the flow control device in the initial control mode 1 and the initial frequency of the compressor in the initial control mode 2, based on the one value or more out of the discharge pressure, the suction pressure, and the outdoor temperature.

6. The air-conditioning apparatus of claim 1, wherein in the initial control mode 1, the controller sets the initial opening degree of the flow control device such that the higher the frequency of the compressor in the heating normal operation mode, the smaller a value to which the initial opening degree of the flow control device is set, and in the initial control mode 2 the controller sets the initial frequency of the compressor such that the higher the frequency of the compressor in the heating normal operation mode, the greater a value to which the initial frequency of the compressor is set.

7. The air-conditioning apparatus of claim 1, wherein:

a second pressure reducing device is further provided downstream of the parallel heat exchangers; and in the heating-defrosting operation mode, the second pressure reducing device is configured to reduce a pressure of the refrigerant flowing out from the one or more parallel heat exchangers out of the plurality of parallel heat exchangers selected as the target to be defrosted.

8. The air-conditioning apparatus of claim 7, wherein the controller controls the flow control device and the second pressure reducing device such that a pressure of the refrigerant flowing in the one or more parallel heat exchangers out of the plurality of parallel heat exchangers selected as the target to be defrosted is in a pressure range lower than the discharge pressure and higher than the suction pressure.

9. The air-conditioning apparatus of claim 8, wherein the main circuit is further provided with a receiver and a third pressure reducing device, the receiver being provided between the first pressure reducing device and the parallel heat exchangers, the third pressure reducing device being provided between the receiver and the parallel heat exchangers and controlled by the controller, and in the case of switching from the heating normal operation mode to the heating-defrosting operation mode, the controller starts the heating-defrosting operation mode after increasing an opening degree of the third pressure reducing device.

10. The air-conditioning apparatus of claim 9, wherein as the frequency of the compressor in the heating normal operation mode decreases, the controller sets an increase in the opening degree of the third pressure reducing device.

11. The air-conditioning apparatus of claim 9, further comprising:

a degree-of-subcooling detector configured to detect a degree of subcooling of the refrigerant at an outlet of the load side heat exchanger in the heating normal operation mode, wherein in the case of switching from the heating normal operation mode to the heating-defrosting operation mode, as the degree of subcooling in the heating normal operation mode decreases, the controller sets an increase in the opening degree of the third pressure reducing device.

12. The air-conditioning apparatus of claim 9, further comprising:

a discharge temperature detector configured to detect a discharge temperature of the refrigerant discharged from the compressor;

a first degree-of-superheat detector configured to detect a first degree of superheat of the refrigerant discharged from the compressor;

a suction temperature detector configured to detect a suction temperature of the refrigerant to be taken into the compressor; and a second degree-of-superheat detector configured to detect a second degree of superheat of the refrigerant to be taken into the compressor, wherein the controller controls, in the heating normal operation mode, the third pressure reducing device such that each of the discharge temperature, first degree-of-superheat, suction temperature, and second degree-of-superheat become corresponding target values, and the controller reduces the corresponding target values before starting the heating-defrosting operation mode.

13. An air-conditioning apparatus including an outdoor unit and an indoor unit connected to the outdoor unit with pipes interposed therebetween, the air-conditioning apparatus comprising:

a main circuit in which a compressor, a load side heat exchanger included in the indoor unit, a first pressure reducing device, and a plurality of parallel heat exchangers included in the outdoor unit and connected in parallel with each other are sequentially connected by the pipes and through which refrigerant circulates;

a bypass pipe diverting a portion of the refrigerant discharged from the compressor and causing the portion of the refrigerant to flow into the parallel heat exchangers;

a flow path switching device provided at the bypass pipe and selecting one or more parallel heat exchangers out of the plurality of parallel heat exchangers as a target to be defrosted;

a flow control device provided at the bypass pipe and adjusting an amount of flow of the refrigerant flowing in the bypass pipe; and a controller configured to control operation of the outdoor unit and the indoor unit, wherein the controller is configured to operate in a heating normal operation mode for causing each of the plurality of parallel heat exchangers to function as an evaporator and a heating-defrosting operation mode for treating the one or more parallel heat exchangers out of the plurality of parallel heat exchangers as the target to be defrosted and causing each other parallel heat exchanger out of the plurality of parallel heat exchangers to function as an evaporator, and in a case of switching from the heating normal operation mode to the heating-defrosting operation mode, the controller is configured to make a selection from an initial control mode 1 and an initial control mode 2 to execute the heating-defrosting operation mode, wherein in the initial control mode 1, control is performed such that an initial frequency of the compressor is set to a predetermined maximum frequency and an initial opening degree of the flow control device is set to an opening degree lower than a predetermined maximum opening degree, and in the initial control mode 2, control is performed such that the initial opening degree of the flow control device is set to the predetermined maximum opening degree and the initial frequency of the compressor is set to a frequency lower than the predetermined maximum frequency, to execute the heating-defrosting operation mode, in the initial control mode 1, the controller sets the initial opening degree of the flow control device such that the higher the frequency of the compressor in the heating normal operation mode, the smaller a value to which the initial opening degree of the flow control device is set, and in the initial control mode 2, the controller sets the initial frequency of the compressor such that the higher the frequency of the compressor in the heating normal operation mode, the greater a value to which the initial frequency of the compressor is set.

* * * * *